US009530636B2

(12) United States Patent
Oh et al.

(10) Patent No.: US 9,530,636 B2
(45) Date of Patent: Dec. 27, 2016

(54) LIGHT SOURCE WITH NANOSTRUCTURED ANTIREFLECTION LAYER

(71) Applicant: KLA-Tencor Corporation, Milpitas, CA (US)

(72) Inventors: Sebaek Oh, Millbrae, CA (US); Anant Chimmalgi, San Jose, CA (US); Rahul Yadav, Sunnyvale, CA (US); Matthew Derstine, Los Gatos, CA (US); Ilya Bezel, Sunnyvale, CA (US)

(73) Assignee: KLA-Tencor Corporation, Milpitas, CA (US)

( * ) Notice: Subject to any disclaimer, the term of this patent is extended or adjusted under 35 U.S.C. 154(b) by 0 days.

(21) Appl. No.: 14/660,849

(22) Filed: Mar. 17, 2015

(65) Prior Publication Data

US 2015/0271905 A1 Sep. 24, 2015

Related U.S. Application Data

(60) Provisional application No. 61/968,161, filed on Mar. 20, 2014.

(51) Int. Cl.

| | |
|---|---|
| ***H01J 65/00*** | (2006.01) |
| ***H01J 61/02*** | (2006.01) |
| ***H01J 65/04*** | (2006.01) |
| *H01J 61/32* | (2006.01) |

(52) U.S. Cl.

CPC ..... *H01J 65/00* (2013.01); *H01J 61/025* (2013.01); *H01J 65/04* (2013.01); *H01J 61/32* (2013.01)

(58) Field of Classification Search

CPC ..... H01J 65/00; H01J 61/025; H01J 65/04; H01J 61/32

USPC ..... 250/432 R, 493.1, 504 R

See application file for complete search history.

(56) References Cited

U.S. PATENT DOCUMENTS

| | | | |
|---|---|---|---|
| 7,378,197 | B2 | 5/2008 | Wasson et al. |
| 7,435,982 | B2 | 10/2008 | Smith et al. |
| 7,786,455 | B2 | 8/2010 | Smith et al. |
| 8,126,677 | B2 | 2/2012 | De Groot et al. |
| 8,350,209 | B2 | 1/2013 | Gaebler et al. |
| 8,553,333 | B2 | 10/2013 | Chang et al. |

(Continued)

OTHER PUBLICATIONS

U.S. Appl. No. 14/231,196, filed Mar. 31, 2014, Ilya Bezel et al.

(Continued)

*Primary Examiner* — Michael Maskell

(74) *Attorney, Agent, or Firm* — Suiter Swantz pc llo

(57) ABSTRACT

A laser-sustained plasma light source includes a plasma cell configured to contain a volume of gas. The plasma cell is configured to receive illumination from a pump laser in order to generate plasma within the volume of gas. The plasma emits broadband radiation. The plasma cell includes one or more transparent portions being at least partially transparent to at least a portion of illumination from the pump laser and at least a portion of the broadband radiation emitted by the plasma. The plasma cell also includes one or more nanostructured layers disposed on one or more surfaces of the one or more transparent portions of the plasma cell. The one or more nanostructure layers form a region of refractive index control across an interface between the one or more transparent portions of the plasma cell and an atmosphere.

49 Claims, 13 Drawing Sheets

(56) References Cited

U.S. PATENT DOCUMENTS

| | | | | |
|---|---|---|---|---|
| 2005/0168148 | A1* | 8/2005 | Allen | H01J 61/35 313/634 |
| 2005/0194907 | A1 | 9/2005 | Krisl et al. | |
| 2007/0228288 | A1 | 10/2007 | Smith et al. | |
| 2007/0228300 | A1 | 10/2007 | Smith et al. | |
| 2010/0264820 | A1 | 10/2010 | Sumitomo et al. | |
| 2011/0181191 | A1* | 7/2011 | Smith | B82Y 10/00 315/149 |
| 2011/0277361 | A1 | 11/2011 | Nichol et al. | |
| 2012/0057235 | A1* | 3/2012 | Chang | B82Y 20/00 359/558 |
| 2013/0003384 | A1* | 1/2013 | Bezel | G02B 26/06 362/276 |
| 2013/0106275 | A1 | 5/2013 | Chimmalgi et al. | |
| 2013/0181595 | A1 | 7/2013 | Bezel et al. | |
| 2013/0344290 | A1 | 12/2013 | Yu et al. | |
| 2014/0291546 | A1 | 10/2014 | Bezel et al. | |

OTHER PUBLICATIONS

U.S. Appl. No. 12/787,827, filed May 26, 2010, Ilya Bezel et al.
George Curatu, Design and fabrication of low-cost thermal imaging optics using precision chalcogenide glass molding, Proc. SPIE 7060, Current Developments in Lens Design and Optical Engineering IX, 706008 (Aug. 29, 2008), 7 pages.
Young Min Song et al., Design of highly transparent glasses with broadband antireflective subwavelength structures, Optics Express, vol. 18, No. 12, Jun. 7, 2010, pp. 13063-13071, © 2010 Optical Society of America.
Takamasa Tamura et al., Molded glass lens with anti-reflective structure, ODF '10, Yokohama, Apr. 21, 2010, © 2010 OSJ, 2 pages.
Kyoo-Chul Park et al., Nanotextured Silica Surfaces with Robust Superhydrophobicity and Omnidirectional Broadband Supertransmissivity, ACS Nano, vol. 6, No. 5, pp. 3789-3799, Published Apr. 8, 2012, © 2012 American Chemical Society.
Lauri Sainiemi et al., Non-Reflecting Silicon and Polymer Surfaces by Plasma Etching and Replication, Materials Views, Advanced Materials, 2010, pp. 1-5, © 2010 Wiley-VCH Verlag GmbH & Co. KGaA, Weinheim.
J.-Q. Xi et al., Optical thin-film materials with low refractive index for broadband elimination of Fresnel reflection, Nature Photonics, vol. 1, Mar. 1, 2007, © 2007 Nature Publishing Group, pp. 176-179.
Lei Zhou et al., Light Manipulation for Organic Optoelectronics Using Bio-inspires Moth's Eye Nanostructures, Nature, Scientific Reports, vol. 4, 4040, Feb. 10, 2014, 8 pages.
Shih-Jung Liu et al., Fast fabrication of nano-structures anti-reflection layers for enhancement of solar cells performance using plasma sputtering and infrared assisted roller embossing techniques, Feb. 27, 2012, vol. 20, No. 5, Optics Express, pp. 5143-5150.
PCT Search Report for International Application No. PCT/US2015/021460, Date of Mailing May 27, 2015, 3 pages.

* cited by examiner

LIGHT SOURCE WITH NANOSTRUCTURED ANTIREFLECTION LAYER

CROSS-REFERENCE TO RELATED APPLICATION

The present application is related to and claims the benefit of the earliest available effective filing date(s) from the following listed application(s) (the "Related Applications") (e.g., claims earliest available priority dates for other than provisional patent applications or claims benefits under 35 USC §119(e) for provisional patent applications, for any and all parent, grandparent, great-grandparent, etc. applications of the Related Application(s)).

RELATED APPLICATIONS

For purposes of the USPTO extra-statutory requirements, the present application constitutes a regular (non-provisional) patent application of United States Provisional Patent Application entitled LAMP FOR LASER SUSTAINED PLASMA WITH NANOSTRUCTURED ANTIREFLECTION LAYER, naming Sebaeck Oh, Anant, Chimmalgi, Rahul Yadav, Matthew Derstine and Ilya Bezel as inventors, filed Mar. 20, 2014, Application Ser. No. 61/968,161.

TECHNICAL FIELD

The present invention generally relates to plasma-based light sources, and, more particularly, to a plasma cell or lamp with a nanostructured antireflective layer.

BACKGROUND

As the demand for integrated circuits having ever-smaller device features continues to increase, the need for improved illumination sources used for inspection of these ever-shrinking devices continues to grow. One such illumination source includes a laser-sustained plasma source. Laser-sustained plasma light sources are capable of producing high-power broadband light. Laser-sustained light sources operate by focusing laser radiation into a gas volume in order to excite the gas, such as argon or xenon, into a plasma state, which is capable of emitting light. This effect is typically referred to as "pumping" the plasma. Traditional plasma cells or lamps include plasma bulbs for containing gas used to generate plasma. Typically, plasma bulbs or lamps used in broadband wafer inspection tools are made of fused silica glass without the use of any additional surface coatings or layers. As a result, at the air-glass interface, Fresnel loss is observed resulting in a significant amount of lost pumping light and emitted broadband light.

As depicted in the conceptual view 10 of FIG. 1A, Fresnel loss results from a mismatch in refractive index at the air-glass interface, such as the interface 16 defined by the volume of air 12 and the surface of the glass 14. As shown in graph 20 of FIG. 1B, when light propagating through the air 12 impinges on the air-glass interface 16, the light begins to experience the refractive index of glass, which is higher than refractive index of air. As a result, a portion of the light is reflected back from the air-glass interface leading to a loss of light transmitted through the interface 16. In a typical air-glass interface, at normal incidence, approximately 4% of incident light power will be lost due to Fresnel loss.

In an effort to reduce this loss, some optics are coated with dielectric-based anti-reflection (AR) coatings, which are commonly formed using multiple layers of thin dielectric films. The temperatures in typical broadband lamps (e.g., plasma source, arc lamp and the like) used in broadband inspection tools are commonly operated at temperatures sufficient to cause significant degradation in the physical and/or optical properties of these dielectric coatings. As a result, typical dielectric AR coatings are not well-suited for use in high temperature environments such as plasma-based broadband light generation. Therefore, it would be desirable to provide an apparatus, system and/or method for curing defects such as those of the identified above.

SUMMARY

A laser-sustained plasma light source is disclosed, in accordance with an illustrative embodiment of the present disclosure. In one illustrative embodiment, the light source includes a plasma cell configured to contain a volume of gas. In another illustrative embodiment, the plasma cell is configured to receive illumination from a pump laser in order to generate a plasma within the volume of gas. In another illustrative embodiment, the plasma emits broadband radiation. In another illustrative embodiment, the plasma cell includes one or more transparent portions. In one illustrative embodiment, the one or more transparent portions are at least partially transparent to at least a portion of illumination from the pump laser and at least a portion of the broadband radiation emitted by the plasma. In another illustrative embodiment, the plasma cell includes one or more nanostructured layers disposed on one or more surfaces of the one or more transparent portions of the plasma cell. In another illustrative embodiment, the one or more nanostructure layers form a region of refractive index control across an interface between the one or more transparent portions of the plasma cell and an atmosphere.

An apparatus for generating broadband laser-sustained plasma light is disclosed. In one illustrative embodiment, the apparatus includes one or more pump lasers configured to generate illumination. In another illustrative embodiment, the apparatus includes a plasma cell configured to contain a volume of gas, wherein the plasma cell configured to receive illumination from the one or more pump lasers in order to generate a plasma within the volume of gas, wherein the plasma emits broadband radiation. In another illustrative embodiment, the plasma cell includes one or more transparent portions being at least partially transparent to at least a portion of illumination from the pump laser and at least a portion of the broadband radiation emitted by the plasma. In another illustrative embodiment, the plasma cell includes one or more nanostructured layers disposed on one or more surfaces of the one or more transparent portions of the plasma cell. In another illustrative embodiment, the one or more nanostructure layers form a region of refractive index control across an interface between the one or more transparent portions of the plasma cell and an atmosphere. In another illustrative embodiment, the apparatus includes a collector element arranged to focus the illumination from the one or more pump lasers into the volume of gas in order to generate a plasma within the volume of gas contained within the plasma cell.

A light source is disclosed. In one illustrative embodiment, the light source includes an arc lamp configured to contain a volume of gas. In another illustrative embodiment, the arc lamp includes a set of electrodes configured to generate a discharge within the volume of gas. In another illustrative embodiment, the arc lamp includes one or more transparent portions being at least partially transparent to at least a portion of the broadband radiation emitted associated with the discharge. In another illustrative embodiment, the arc lamp includes one or more nanostructured layers disposed on one or more surfaces of the one or more transparent portions of the arc lamp. In another illustrative embodiment, the one or more nanostructure layers form a region of refractive index control across an interface between the one or more transparent portions of the arc lamp and an atmosphere.

An apparatus for generating broadband laser-sustained plasma light is disclosed. In one illustrative embodiment, the apparatus includes one or more pumping lasers configured to generate illumination. In another illustrative embodiment, the apparatus includes a gas containment structure. In another illustrative embodiment, the apparatus includes a collector element including a concave region mechanically coupled to the gas containment structure in order to contain a volume of gas, wherein the collector element is arranged to focus the illumination from the one or more pumping lasers into the volume of gas to generate a plasma within the volume of gas contained by the concave region of the collector element and the gas containment structure. In another illustrative embodiment, the apparatus includes a first transparent portion configured to transmit illumination from the one or more pumping lasers into the gas containment structure. In another illustrative embodiment, the apparatus includes an additional transparent portion configured to transmit broadband radiation from the plasma to a region external to the gas containment structure, wherein one or more nanostructure layers are formed on one or more surfaces of at least one of the first transparent portion or the additional transparent portion, wherein the one or more nanostructure layers form a region of refractive index control across an interface defined by at least one of the first transparent portion or the additional transparent portion and at least one of a gas internal to the gas containment structure or a gas external to the gas containment structure.

A method for forming a broadband light source with one or more antireflective surfaces. In one illustrative embodiment, the method includes providing a lamp having one or more transparent portions. In another illustrative embodiment, the method includes forming one or more nanostructures at one or more surfaces of the one or more transparent portions of the lamp such that the one or more nanostructures form a region of refractive index control between the one or more transparent portions of the plasma cell and at least one of a volume internal to the plasma cell or a volume external to the plasma cell.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the disclosure may be better understood by those skilled in the art by reference to the accompanying figures in which:

FIGS. 1M-1P are cross-sectional views of a series of non-periodic nanostructures suitable for use in the nanostructure layer, in accordance with one or more embodiments of the present disclosure.

DETAILED DESCRIPTION OF THE INVENTION

Figure 1A:
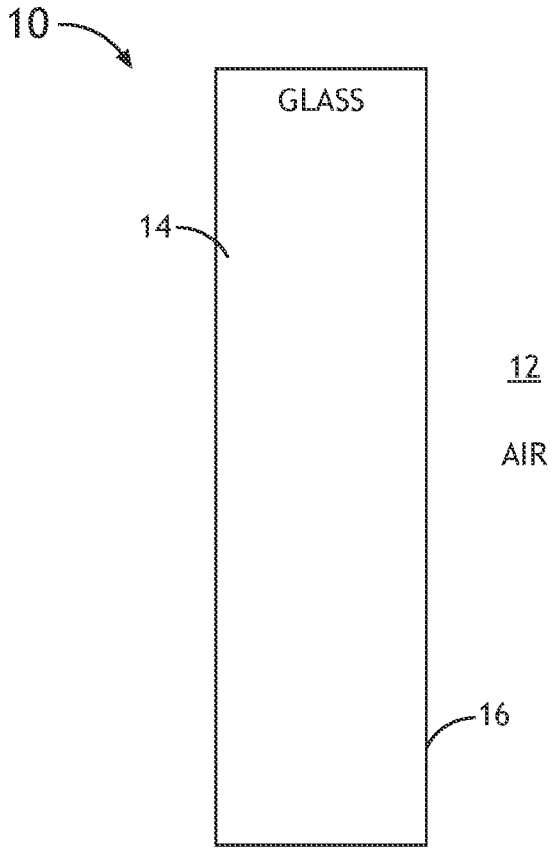
FIG. 1A is a conceptual view of an abrupt air-glass interface, in accordance with one embodiment of the present disclosure.
Figure 1B:
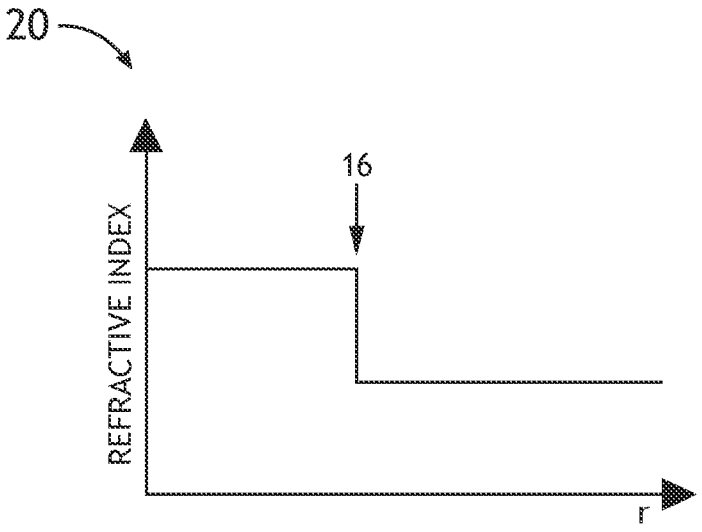
FIG. 1B is a graph of refractive index as a function of position across an abrupt air-glass interface, in accordance with one embodiment of the present disclosure.

Reference will now be made in detail to the subject matter disclosed, which is illustrated in the accompanying drawings.

Referring generally to FIGS. 1C through 1N, a broadband illumination source equipped with one or more nanostructured layers is described in accordance with the present disclosure. Some embodiments of the present disclosure are directed to the generation of radiation with a light-sustained plasma light source. The light-sustained plasma light source may include a plasma cell equipped with a plasma bulb or transmission element that is transparent to both the pumping light (e.g., light from a laser source) used to sustain a plasma within the plasma cell as well as the broadband radiation emitted by the plasma. Additional embodiments of the present disclosure provide for one or more nanostructured layers formed on one or more transparent portions of a plasma cell or lamp. A nanostructured layer may be formed such that it reduces reflectivity at the given optical interface. For example, a plasma cell may have a nanostructured antireflection (AR) layer disposed on the inside and/or outside surfaces of a transparent portion of the plasma cell. In this regard, the one or more nanostructure layers of the present disclosure may serve to reduce reflectivity of an optical surface (e.g., external air-glass interface or internal glass-gas interface) of the plasma cell. For instance, the one or more nanostructure layers of the present disclosure may reduce the reflectivity of the given optical surface to pumping radiation and/or plasma-emitted broadband radiation. Such a configuration serves to reduce the loss of pumping laser light and the loss of broadband plasma radiation at the air-glass and/or glass-gas interfaces of the plasma cell. Due to the decreased loss provided by the various embodiments of the present disclosure, embodiments of the present disclosure provide for increased illumination throughput out of the plasma and improved broadband wafer inspection throughput.

In addition, the nanostructured layer of the present disclosure may include a set of small scale structures. These small scale features allow for a gradual transition between an atmosphere (e.g., air outside or plasma cell or gas within plasma cell) and the material of the transparent portion of the plasma cell (e.g., transparent wall of the plasma bulb or transparent wall of transmission element). This gradual transition between atmosphere and the given optical material produces an effective refractive index in this transition region, which gradually changes from the refractive index of the given atmosphere to the refractive index of the optical material of the plasma cell.

In other embodiments of the present disclosure, the one or more nanostructure layers may be used in the context of a discharge lamp, such as, but not limited to, an arc lamp.

In other embodiments of the present disclosure, the one or more nanostructure layers may be used in the context of any optical system requiring one or more transparent interfaces. The one or more nanostructure layers may be used in any number of high temperature optical environments. For instance, the one or more nanostructure layers may be used on one or more windows of a bulb-less plasma-based broadband light source.

Figure 1C:
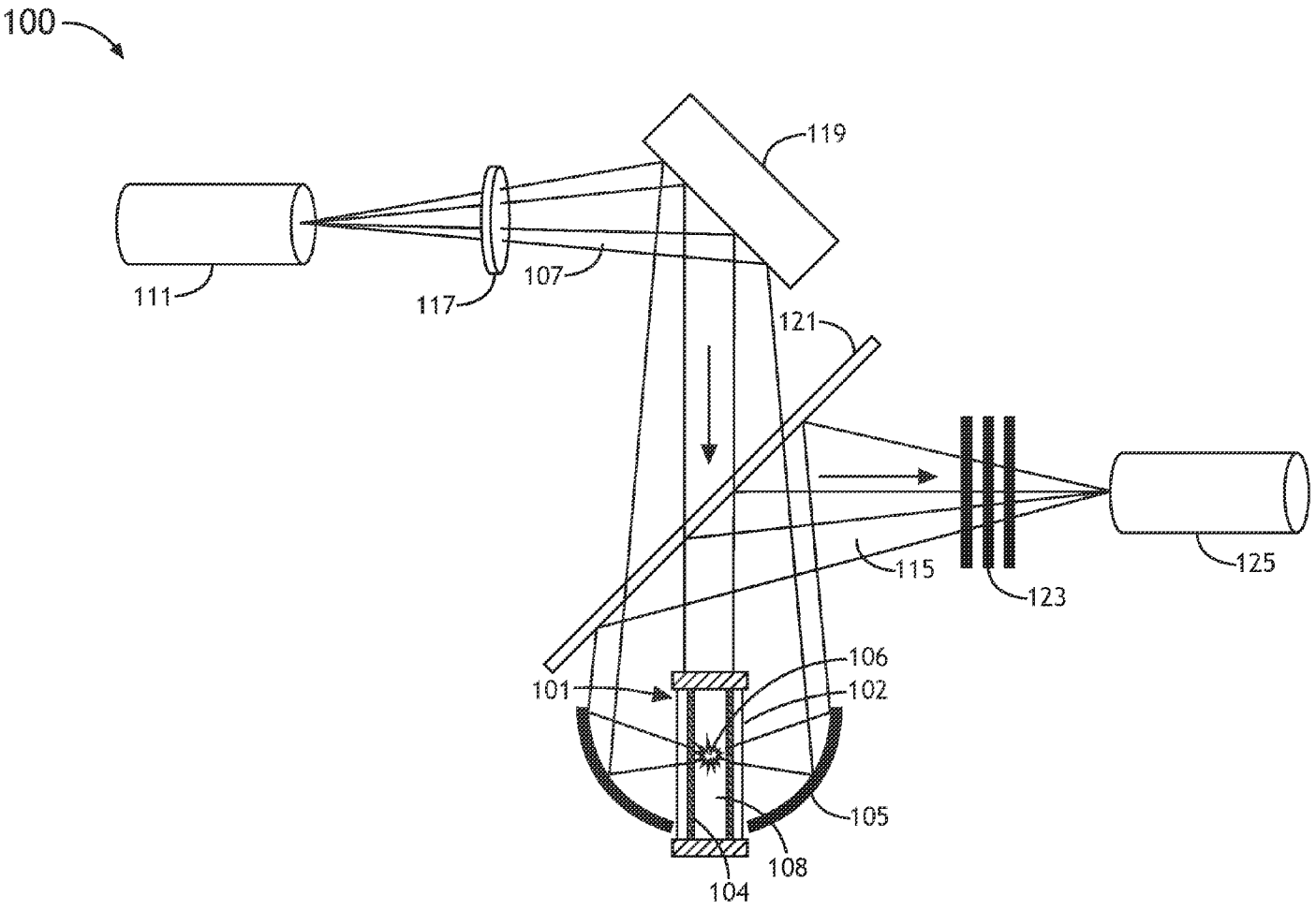
FIG. 1C is a high level schematic view of a system for generating plasma-based broadband light that is equipped with one or more nanostructure layers, in accordance with one embodiment of the present disclosure.

FIG. 1C illustrates a system 100 for forming light-sustained plasma equipped with a plasma cell 101 having one or more nanostructured optical surfaces, in accordance with one or more embodiments of the present disclosure. The generation of plasma within inert gas species is generally described in U.S. patent application Ser. No. 11/695,348, filed on Apr. 2, 2007; and U.S. patent application Ser. No. 11/395,523, filed on Mar. 31, 2006, which are incorporated herein in their entirety. Various plasma cell designs are described in U.S. patent application Ser. No. 13/647,680, filed on Oct. 9, 2012, which is incorporated herein by reference in the entirety. Plasma cell and plasma bulb designs are described in U.S. patent application Ser. No. 13/741,566, filed on Jan. 15, 2013, which is incorporated herein by reference in the entirety. The generation of plasma is also generally described in U.S. patent application Ser. No. 14/224,945, filed on Mar. 25, 2014, which is incorporated by reference herein in the entirety.

In one embodiment, the system 100 includes an illumination source 111 (e.g., one or more lasers) configured to generate illumination 107 of a selected wavelength or wavelength range, such as, but not limited to, infrared radiation or visible radiation. In another embodiment, the system 100 includes a plasma cell 101 for generating, or maintaining, plasma 106. In another embodiment, the plasma cell 101 includes one or more transparent portions 102. In one embodiment, the transparent portion 102 of the plasma cell 101 is configured to receive illumination from the illumination source 111 in order to generate a plasma 106 within a plasma generation region of a volume of gas 108 contained within the plasma cell 101. In this regard, one or more transparent portions 102 of the plasma cell 101 are at least partially transparent to the illumination generated by the illumination source 111, allowing illumination delivered by the illumination source 111 (e.g., delivered via fiber optic coupling or delivered via free space coupling) to be transmitted through the transparent portion 102 and into the plasma cell 101. In another embodiment, upon absorbing illumination from illumination source 111, the plasma 106 emits broadband radiation (e.g., broadband IR, broadband visible, broadband UV, broadband DUV, broadband VUV and/or broadband EUV radiation). In another embodiment, one or more transparent portions 102 of the plasma cell 101 are at least partially transparent to at least a portion of the broadband radiation emitted by the plasma 106. It is noted herein that the one or more transparent portions of the plasma cell 101 may be transparent to both illumination 107 from the illumination source 111 and broadband illumination 115 from the plasma 106.

Figure 1D:
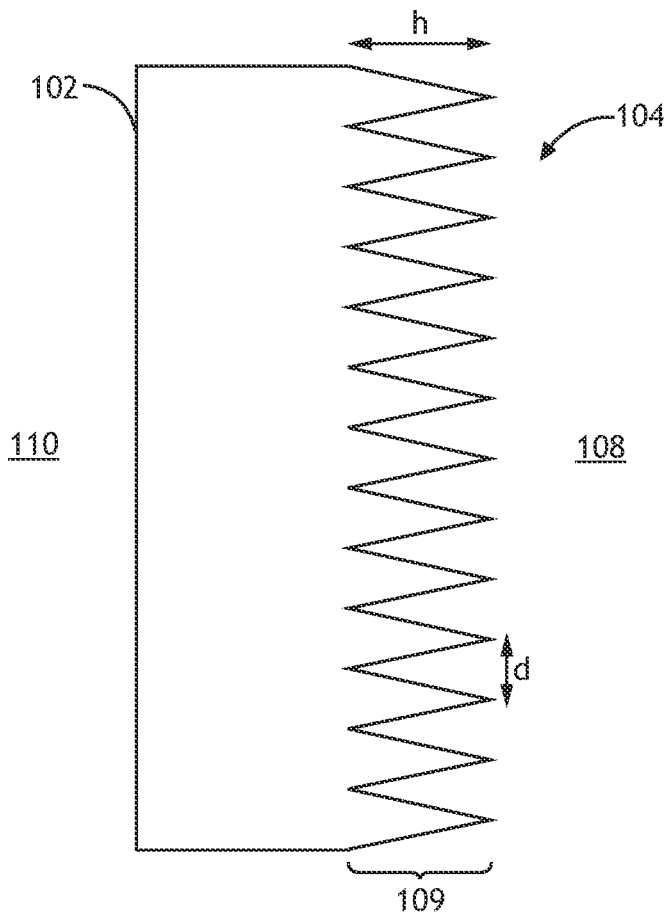
FIG. 1D is a conceptual view of a gradual air-glass interface formed with a nanostructure layer, in accordance with one embodiment of the present disclosure.

In one embodiment, one or more nanostructure layers 104 are formed at one or more surfaces of the one or more transparent portions 102 of the plasma cell 101. As shown in FIG. 1D, the one or more nanostructured layers 104 may form a region of refractive index control across an interface 109 between the one or more transparent portions 102 of the plasma cell 101 and an atmosphere (e.g., air 110 outside of plasma cell 101 or gas 108 inside of plasma cell 108).

In one embodiment, the nanostructure layer 104 includes a set of periodic or non-periodic structures, or features. For example, the periodic or non-periodic may include, but are not limited to, sub-wavelength structures, which have a size smaller than the wavelength of light in question (e.g., pumping light 107 or broadband light 115). In this regard, the periodic structures of the one or more nanostructure layers 104 serve to increase the spatial length of the interface 109 from that of an abrupt interface (e.g., interface 16 in FIG. 1A). The extended interface 109 of the present disclosure is depicted, for example, in FIG. 1D.

As shown in FIG. 1D, the structures provide a gradual transition between an atmosphere (e.g., gas 108 within plasma cell 101) and the bulk material of the transparent portion 102 of the plasma cell 101 (e.g., transparent wall of the plasma bulb or transparent wall of transmission element). This gradual transition between a gas 108 and the transparent portion 102 of the plasma cell 101 produces an effective refractive index in the transition region 109, which gradually changes from the refractive index of the gas 108 to the refractive index of the bulk optical material of the transparent portion 102 of the plasma cell 101.

It is noted herein that the sub-wavelength nature of the structures of the one or more nanostructure layers 104 allows for light incident on the interface 109 to experience an averaging of the properties of the material forming the structures of the nanostructure layer 104 and the atmosphere/gas surrounding these structures. This averaging allows for the gradual transition in the refractive index from the refractive index of the gas (e.g., 108/110) to the refractive index of the bulk optical material of the transparent portion 102 of the plasma cell 101. The use of sub-wavelength structures in the nanostructure layer 104 allows for the gradual transition in refractive index using a single material and structure, where atmosphere (e.g., gas 108/gas 110) resides on one side of the interface 109 and all bulk optical material 102 located at the other side of the interface 109.

Figure 1E:
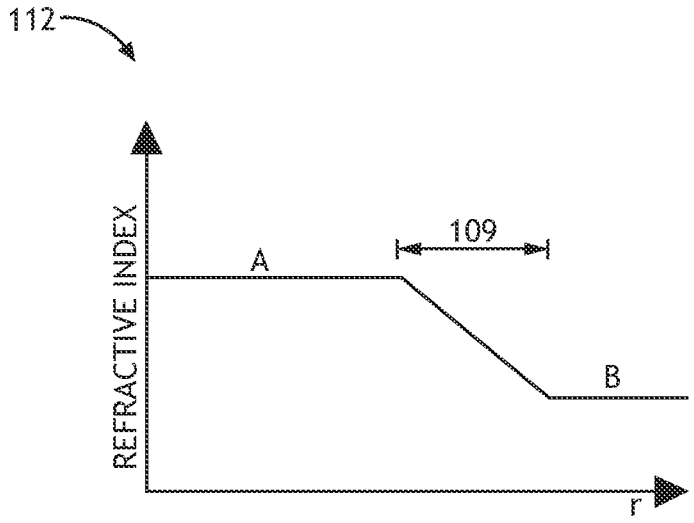
FIG. 1E is a graph of refractive index as a function of position across the gradual air-glass interface formed with a nanostructure layer, in accordance with one embodiment of the present disclosure.

FIG. 1E illustrates a conceptual view of a graph 112 of refractive index displayed as a function of position r. For example, in the case of a cylindrical plasma cell 101, the refractive index (displayed as a function of radius r) experienced by light passing through the wall of the transparent portion 102 of the plasma cell 101 starts at an initial value A. Then, as the light enters the expanded interface 109, the effective index of refraction experienced by the light gradually transitions from the initial value A to a second value B, associated with the gas 108 in that spatial region. Then, after light leaves the interface 109, the light fully experiences the second refractive index value B. In this sense, the change between the initial refractive index value A and the second refractive index value B is continuous across the interface 109. In another embodiment, the change in refractive index across the interface 109 may take the form of a selected profile based on the selected characteristics of the nanostructures used to form nanostructure layer 104. It is noted herein that, while FIG. 1E depicts the transition in refractive index across the interface 109 as being linear, this is not a requirement of the present disclosure. It is recognized herein that the refractive index transition may take on a variety of forms and is a function of the rate at which the gas/material volume composition changes across the mixed interface 109.

It is noted herein that the gradual change in refractive index across the interface 109 serves to reduce Fresnel loss at the given interface 109. The reduction in loss at the interface 109 reduces reflection of light incident on the interface. In this regard, the nanostructure layer 104 serves as an antireflection (AR) layer at the given gas/material interface 109. For example, the nanostructure layer 104 may reduce the reflection of illumination 107 as it leaves the bulk optical material of transparent portion 102, traverses interface 109, and propagates into the gas 108 contained in the internal volume of the plasma cell 101. By way of another example, the nanostructure layer 104 may reduce reflection of broadband illumination 115 emitted by the plasma 106 as it leaves the gas 108, traverses interface 109 and propagates through the bulk material of the transparent portion 102 and out of the plasma cell 101 and into the gas 110 external to the plasma cell 101. In this regard, Fresnel loss is reduced for the pump radiation 107 and the broadband radiation 115, resulting in increased pumping radiation 107 delivered to the plasma 106 and an increased level of generated broadband radiation 115 collected outside of the plasma cell 101.

Further, the one or more nanostructure layers 104 of the plasma cell 101 may serve to reduce light coupling to wave-guiding modes that propagate light inside the transparent portion 102 of the plasma cell 101 (or other transparent optical elements). These modes may cause illumination and degradation of other lamp structural components located farther away from the plasma, such as, but not limited to, sealing materials.

Figure 1F:
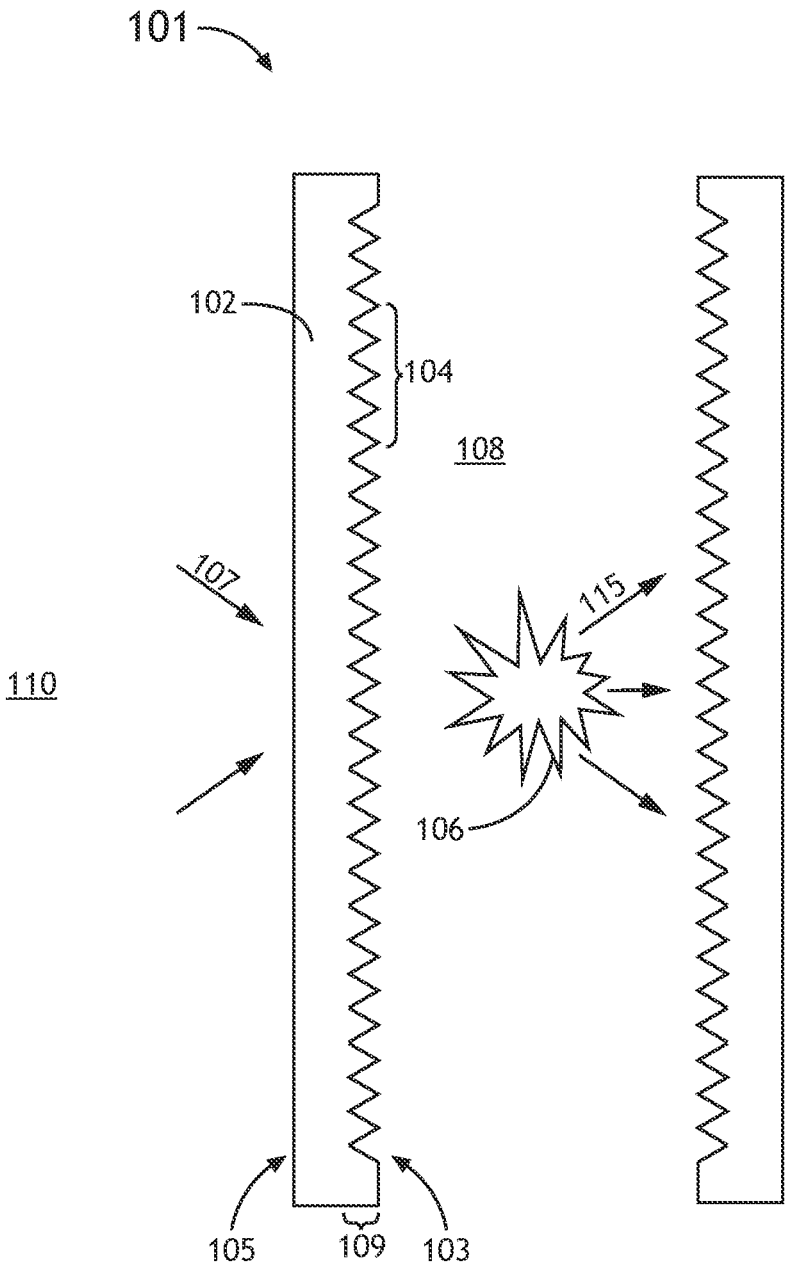
FIG. 1F is a cross-sectional view of a portion of a plasma cell equipped with a nanostructure layer formed at the internal surface of the transparent portion of the plasma cell, in accordance with one embodiment of the present disclosure.
Figure 1G:
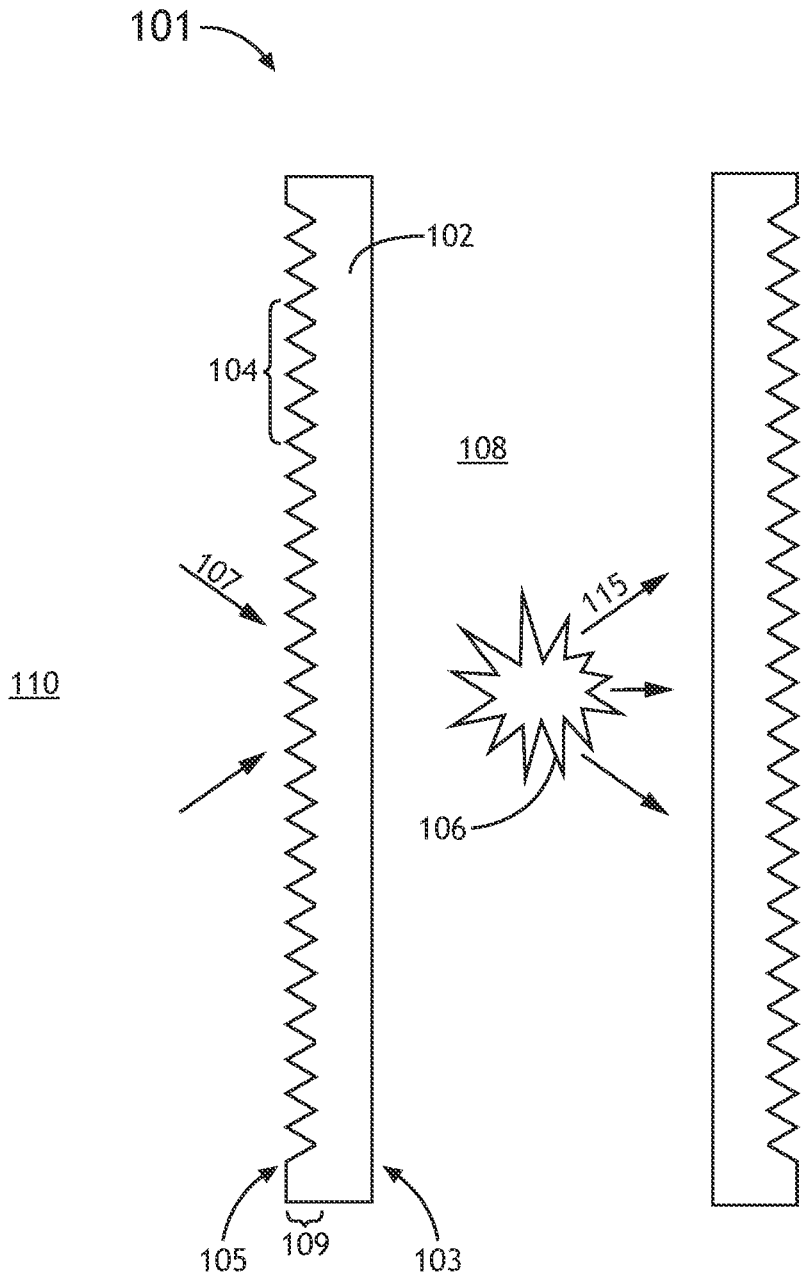
FIG. 1G is a cross-sectional view of a portion of a plasma cell equipped with a nanostructure layer formed at the external surface of the transparent portion of the plasma cell, in accordance with one embodiment of the present disclosure.
Figure 1H:
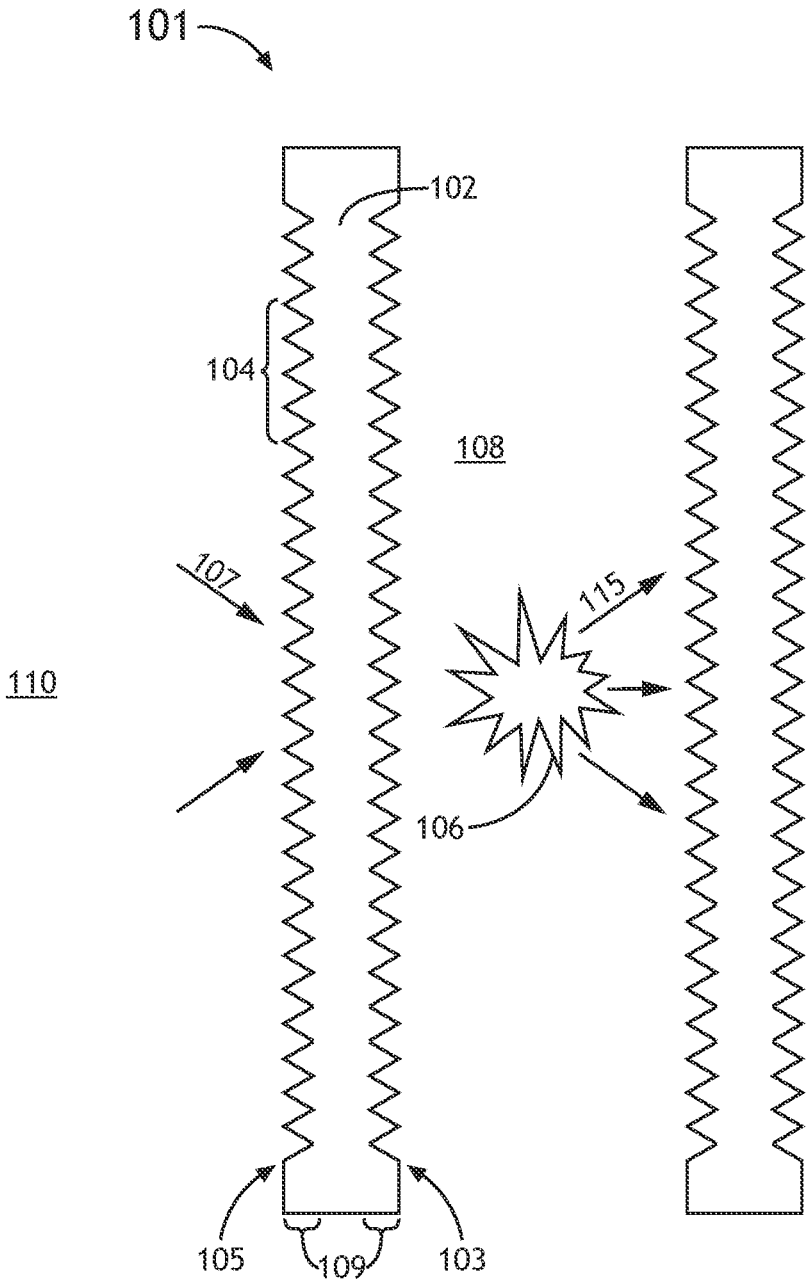
FIG. 1H is a cross-sectional view of a portion of a plasma cell equipped with a first nanostructure layer formed at the internal surface of the transparent portion of the plasma cell and a second nanostructure layer formed at the external surface of the transparent portion of the plasma cell, in accordance with one embodiment of the present disclosure.

FIGS. 1F-1H illustrate a cross-sectional view of a transparent portion 102 of the plasma cell 101 with a nanostructure layer 104 disposed at one or more surfaces of the transparent portion 102 of the plasma cell 101, in accordance with one or more embodiments of the present disclosure. In one embodiment, as shown in FIG. 1F, the nanostructured layer 104 is disposed at an internal surface 103 of the transparent portion 102 of the plasma cell 101. In this regard, the nanostructure layer 104 forms a region of refractive index control across an interface 109 between the one or more transparent portions 102 of the plasma cell 101 and an atmosphere contained within the internal volume of the plasma cell 101. For example, the atmosphere contained within the volume 108 may include the gas species (e.g., xenon, argon and the like) used to form plasma 106, which, in turn, emits broadband radiation 115.

In another embodiment, as shown in FIG. 1G, the nanostructured layer 104 is disposed at an external surface 105 of the transparent portion 102 of the plasma cell 101. In this regard, the nanostructure layer 104 forms a region of refractive index control across an interface 109 between the external atmosphere 110 (e.g., air) and one or more transparent portions 102 of the plasma cell 101. For example, the atmosphere 110 external to the plasma cell 101 may include, but is not limited to, air, a purge gas (e.g., argon) or any gas with which the plasma cell 101 is housed.

In another embodiment, as shown in FIG. 1H, the transparent portion 102 of the plasma cell 101 may include an internal nanostructure layer 104 formed at the internal surface 103 of the transparent portion 102 and an external nanostructure layer 104 formed at the external surface 105 of the transparent portion 102. In this regard, the one or more nanostructure layers 104 of plasma cell 101 may reduce reflectivity of pumping radiation 107 at the external surface 105 (e.g., external air-glass interface) and the internal surface 103 (e.g., gas-glass interface) and/or reduce reflectivity of broadband radiation 115 emitted by the plasma 106 at the internal surface 103 (e.g., gas-glass interface) and the external surface 105.

By way of example, in the absence of the one or more nanostructure layers 104 of the present disclosure, Fresnel loss at an air-glass interface at normal incidence may be approximately 4%. The formation of a nanostructure layer 104 at both the external surface 105 and the internal surface 103 may result in more than an additional 8% of pumping radiation 107 reaching the plasma 106. As a result, the plasma 106 will emit more light. In turn, when broadband radiation 115 from the plasma propagates through the transparent portion 102 of the plasma cell 101, an additional 8% loss of the broadband light is avoided, resulting in an even more intense broadband output. The increased broadband output 115 results in more light available for sample inspection (e.g., wafer broadband inspection) than the case without one or more nanostructure layers 104 for the same amount of pumping laser power.

In another embodiment, the one or more nanostructure layers 104 of plasma cell 101 may be formed of the same material as the material used to form the transparent portion 102 of the plasma cell 101. As a result, the one or more nanostructure layers 104 may be as resistant to high temperature as the transparent portion 102 of the plasma cell 101. It is noted herein that this feature is especially useful in the case of nanostructure layers 104 disposed on one or more surfaces 103, 105 of the plasma cell 101 because these surfaces are significantly elevated during plasma generation. The temperature resistance of the one or more nanostructure layers 104 of the present disclosure aid in avoiding thermal degradation often observed in applied dielectric coatings. For example, fabricating the one or more nanostructure layers 104 from the same material as the transparent portion 102 of the plasma cell 101 may lead to an AR layer, which is resistant to thermal degradation processes such as, but not limited to, coating modification, loss of performance, peeling and grazing.

It is noted herein that the one or more nanostructure layers 104 may be formed utilizing any fabrication technique known in the art. In one embodiment, the one or more nanostructure layers 104 are formed at one or more interfaces 103, 105 of the plasma cell 101 with an etching process. For example, any etching procedure suitable for etching away material of the transparent portion 102 of plasma cell 101 so as to form the set of structures of one or more nanostructure layers 104 may be utilized.

In one embodiment, any etching process (e.g., plasma etching) suitable for creating sub-wavelength structures at one or more surfaces of the transparent portion 102 of the plasma cell 101 is used for form the nanostructure layer 104. In this sense, an etching process may be used to form structures that are smaller than the wavelength of the pumping radiation 107 and/or the wavelengths associated with the broadband radiation 115.

By way of non-limiting example, a plasma etching process may be used to form structures having a width of approximately 10-300 nm, a pitch of approximately 20-400 nm, and a height of approximately 20-500 nm on one or more portions of the internal surface 103 or external surface 105 of the transparent portion 102 of plasma cell 101. The formation of sub-wavelength structures via an etching process is generally described by Kyoo-Chul Part et al. in *Nanotextured Silica Surfaces with Robust Superhydrophobicity and Omnidirectional Broadband Supertransmissivity*, ACS Nano Vol. 6 Issue 5, pp. 3789-3799 (2012), which is incorporated herein by reference in the entirety. The formation of sub-wavelength structures via an etching process is also generally described by Lauri Sainiemi et al. in *Non-Reflecting Silicon and Polymer Surfaces by Plasma Etching and Replication*, Advanced Materials Vol. 23 Issue 1, pp. 122-126 (2011), which is incorporated herein by reference in the entirety.

In another embodiment, the one or more nanostructure layers 104 are formed at one or more interfaces 103, 105 of the plasma cell 101 with an electron-beam (EB) lithography process.

In another embodiment, the one or more nanostructure layers 104 are formed at one or more interfaces 103, 105 of the plasma cell 101 with a molding process. In one embodiment, any molding process suitable for creating sub-wavelength structures at one or more surfaces of the transparent portion 102 of the plasma cell 101 may be used to form the nanostructure layer 104. For example, the formation of sub-wavelength structures via a molding and EB process is generally described by Takamasa Tamura et al. in *Molded Glass Lens with Anti-Reflective Structure*, Proc. ODF 2010 Yokohama, 21SS-05 ODF (2010), which is incorporated herein by reference in the entirety. By way of another example, the formation of structures via a molding process, which may be adapted in order to form nanostructure layer 104, is generally described by George Curatu in *Design and Fabrication of Low-Cost Thermal Imaging Optics using Precision Chalcogenide Glass Molding*, Proc. SPIE, 7060; 706008 (2008), which is incorporated herein by reference in the entirety.

In another embodiment, the nanostructured layer 104 is formed from one or more materials that are different form the material used to form the transparent portion 102 of the plasma cell 101. In this regard, the one or more nanostructure layers 104 may be deposited or assembled on one or more surfaces of the transparent portion 102 of the plasma cell 101. The deposited nanostructure layer 104 may be formed in any manner known in the art of nanostructure formation. For example, the formation of graded-index films on a substrate is generally described by J. Q. Xi et al. in *Optical Thin-Film Materials with Low Refractive Index for Broadband Elimination of Fresnel Reflection*, Nature Photonics, Vol. 1 Mar. 2007, pp. 176-179, which is incorporated herein by reference in the entirety.

Figure 1J:
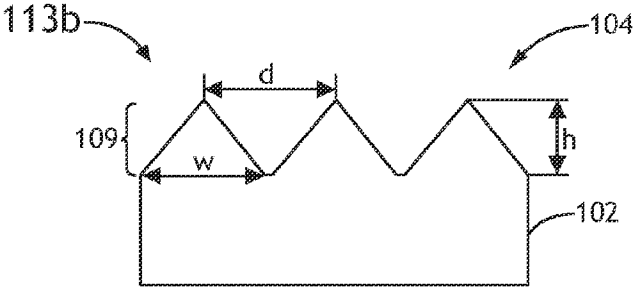
FIGS. 1I-1L are cross-sectional views of a series of shapes of nanostructures suitable for use in the nanostructure layer, in accordance with one or more embodiments of the present disclosure.
Figure 1I:
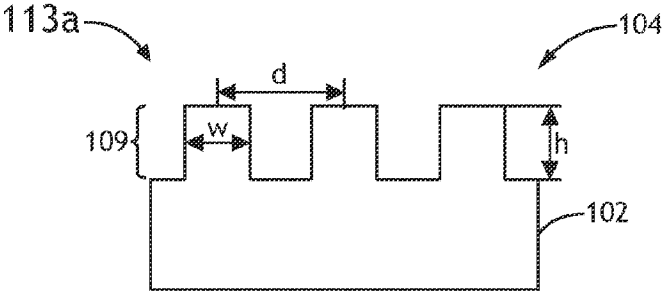

FIGS. 1I-1L illustrate a series of conceptual cross-section views of periodic structures suitable for implementation in the nanostructure layer 104, in accordance with one or more embodiments of the present disclosure. For example, as shown in FIG. 1I, the periodic structures of the nanostructure layer 104 may include, but are not limited to, a set of nanorods. The nanorods of 113*a* may have a characteristic height h, a characteristic width w, and may be spaced according to a selected pitch d.

In another embodiment, as shown in conceptual cross-sectional view 113*b* of FIG. 1J, the periodic structures of the nanostructure layer 104 may include, but are not limited to, a set of nanocones. The nanocones of 113*b* may have a characteristic height h, a characteristic width w, and may be spaced according to a selected pitch d.

Figure 1L:
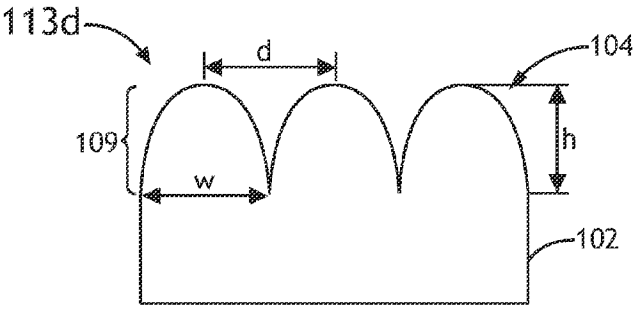
Figure 1K:
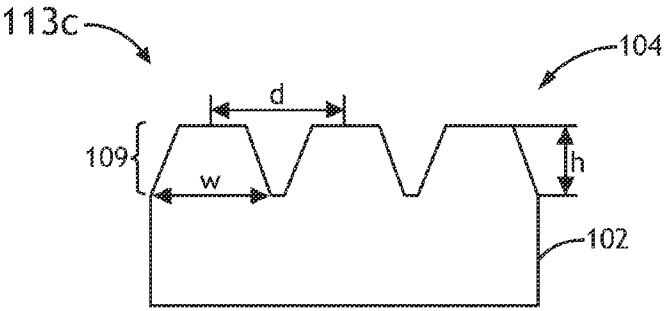

In another embodiment, as shown in conceptual cross-sectional view 113*c* of FIG. 1K, the periodic structures of the nanostructure layer 104 may include, but are not limited to, a set of truncated nanocones. The truncated nanocones of 113*c* may have a characteristic height h, a characteristic width w, and may be spaced according to a selected pitch d.

In another embodiment, as shown in conceptual cross-sectional view 113*d* of FIG. 1L, the periodic structures of the nanostructure layer 104 may include, but are not limited to, a set of nanoparaboloids. The nanoparaboloids of 113*d* may also have a characteristic height h, a characteristic width w, and may be spaced according to a selected pitch d.

It is noted herein that the nanostructure layer 104 of the present disclosure is not limited to the regular shapes and periodic spacing depicted above, which are provided merely for illustrative purposes.

Figure 1M:
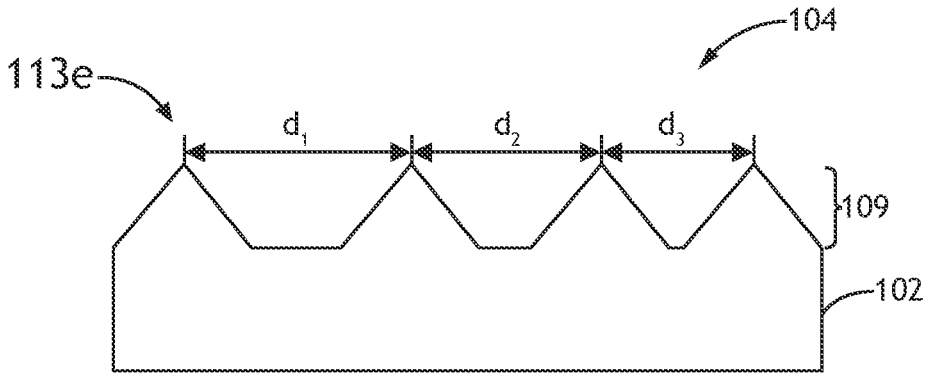

FIG. 1M illustrates illustrate a conceptual cross-section view 113*e* of a nanostructure layer 104 made up of non-periodic structures, in accordance with one or more embodiments of the present disclosure. For example, as shown in 113*e* of FIG. 1M, the structures of the nanostructure layer 104 may be spaced apart in a non-periodic manner. In this regard, the spacing between structures may vary (e.g., vary randomly) across the nanostructure layer 104. For instance, as shown in FIG. 1M, the first structure and second structure have a spacing of $d_1$, while the second structure and a third structure have a spacing of $d_2$ and the third structure and a fourth structure have a spacing of $d_3$ and so on, up to an Nth spacing $d_N$. In one embodiment, the spacings $d_1$-$d_N$ may vary according to a selected pattern. In another embodiment, the spacings d1-dN may vary randomly.

Figure 1N:
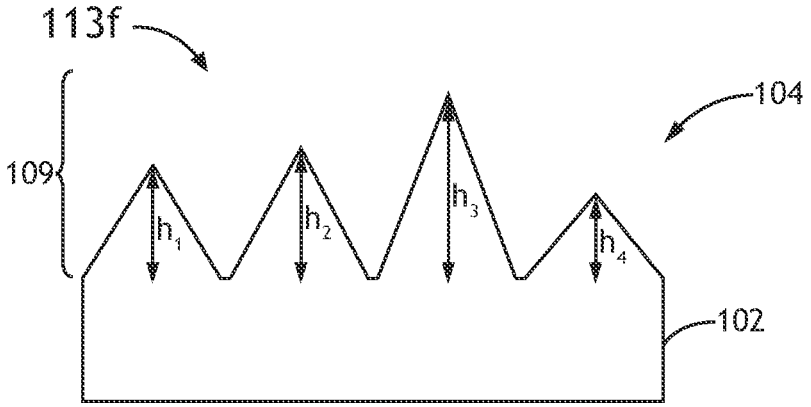
Figure 10:
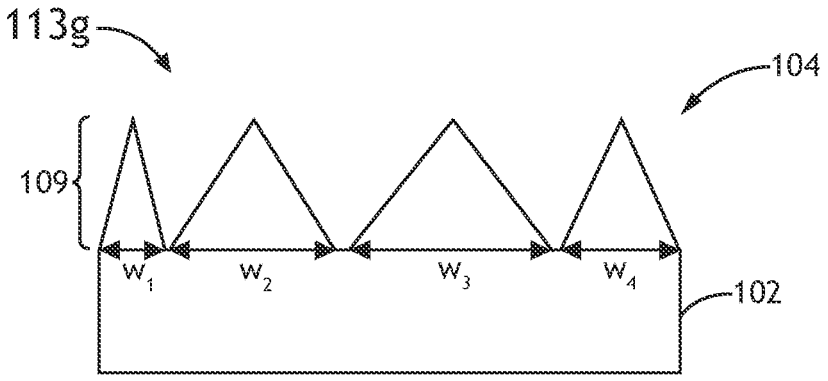
Figure 1P:
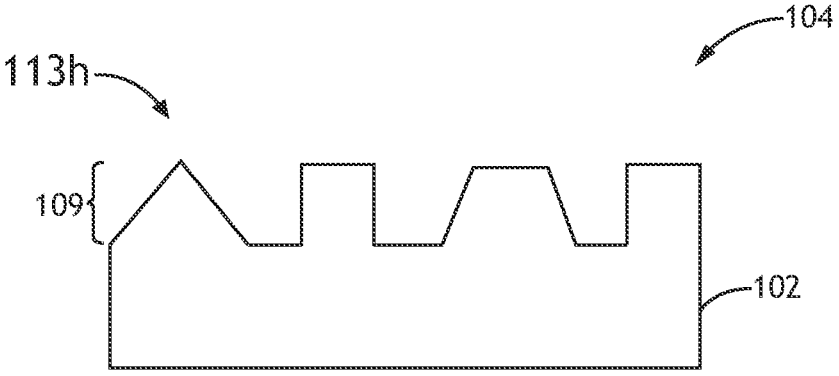

FIGS. 1N-1P illustrate conceptual cross-section view of a nanostructure layer 104 made up of structures having varying characteristic features, in accordance with one or more embodiments of the present disclosure. The varying characteristic feature of the structures may include any physical feature of the structures that make up the nanostructure layer 104. For instance, the characteristic features may include, but are not limited to, height, width, shape and the like. For example, as shown in 113*f* of FIG. 1N, the height of the structures of the nanostructure layer 104 may vary across the nanostructure layer. In one embodiment, the height of the structures may vary according to a selected pattern. In another embodiment, the height of the structures may vary randomly.

By way of another example, as shown in 113*g* of FIG. 1O, the width of the structures of the nanostructure layer 104 may vary across the nanostructure layer. In one embodiment, the width of the structures may vary according to a selected pattern. In another embodiment, the width of the structures may vary randomly.

By way of another example, as shown in 113*h* of FIG. 1P, the shape of the structures of the nanostructure layer 104 may vary across the nanostructure layer. In one embodiment, the shape of the structures may vary according to a selected pattern. In another embodiment, the shape of the structures may vary randomly. It is noted herein that the nanostructure layer 104 may be made up any combination of structures known in the art of nanostructure formation and is not limited to the combination depicted in FIG. 1P.

It is noted herein that the nanostructure layer 104 of the present disclosure is not limited to the structures and/or arrangements described and illustrated in FIGS. 1I-1P. Rather, these structures and arrangements are provided merely for illustrative purposes. The nanostructures of the one or more nanostructure layers 104 may take on any regular or irregular shape known in the art of nanostructure fabrication. Moreover, it is further recognized that the registration and spacing of the nanostructures of the one or more nanostructure layers 104 may vary in any manner known in the art. It is recognized that any number of nanostructures, or sub-wavelength structures, may be used to form the one or more nanostructure layer 104 of the present disclosure.

A variety of sub-wavelength structures are described by Young Min Song et al. in *Design of Highly Transparent Glasses with Broadband Antireflective Subwavelength Structures*, Optics Express, Vol. 18 Issue 12, pp. 13063-13071 (2010), which is incorporated herein by reference in the entirety. Sub-wavelength structures are also described by Kyoo-Chul Part et al. in ACS Nano Vol. 6 Issue 5, pp. 3789-3799 (2012), which is incorporated above in the entirety.

It is noted herein the plasma cell 101 of the present disclosure may include any gas containing structure known in the art of plasma-based light sources suitable for initiating and/or maintaining a plasma 106.

Figure 1R:
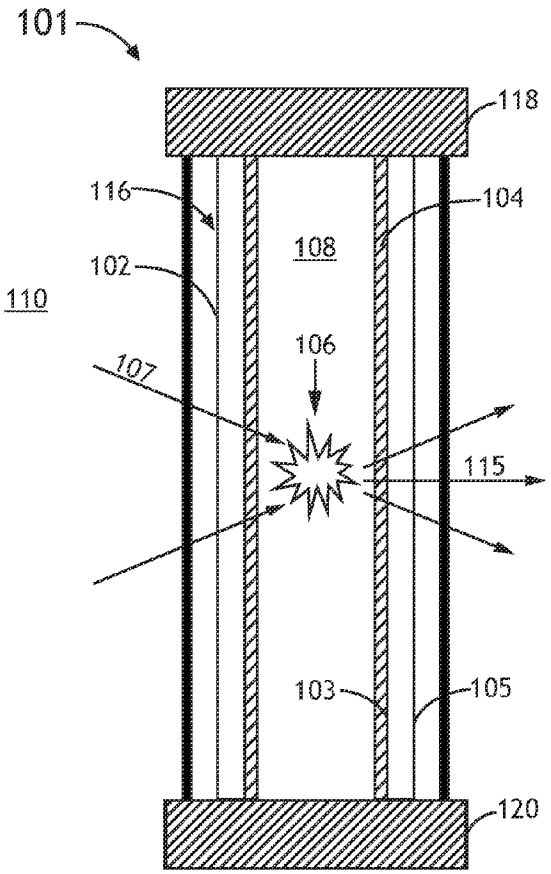
FIG. 1R is a cross-sectional view of a flanged transmission element equipped with a nanostructure layer, in accordance with one embodiment of the present disclosure.
Figure 1Q:
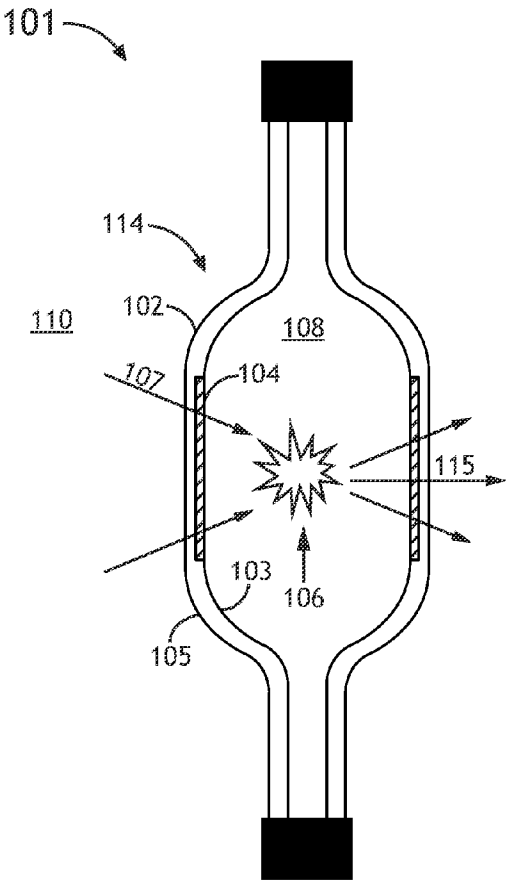
FIG. 1Q is a cross-sectional view of a plasma bulb equipped with a nanostructure layer, in accordance with one embodiment of the present disclosure.

Referring to FIG. 1Q, in one embodiment, the plasma cell 101 may include a plasma bulb 114 suitable for containing a volume of gas 108. The plasma bulb 114 is suitable for initiating and/or maintaining plasma 106. In this regard, the transparent portion 102 of the plasma cell 101 may consist of the transparent portion (or wall) of the plasma bulb 114, as shown in FIG. 1Q. The implementation of a plasma bulb is generally described in U.S. patent application Ser. No. 11/695,348, filed on Apr. 2, 2007; U.S. patent application Ser. No. 11/395,523, filed on Mar. 31, 2006; and U.S. patent application Ser. No. 13/647,680, filed on Oct. 9, 2012, which are each incorporated previously herein by reference in the entirety.

As shown in FIG. 1Q, the one or more nanostructure layers 104 may be formed on one or more surfaces of plasma bulb 114. For example, as shown in FIG. 1Q, a nanostructure layer 104 of the present disclosure may be formed on the internal bulb-gas interface in a manner similar to that described generally with respect to FIG. 1F. By way of another example, although not shown here, a nanostructure layer 104 of the present disclosure may be formed on the external bulb-air interface 105 in a manner similar to that described generally with respect to FIG. 1G. By way of another example, although not shown here, a first nanostructure layer 104 may be formed on the internal bulb-gas interface 103, with a second nanostructure layer 104 being formed on external bulb-air interface 105 in a manner similar to that described generally with respect to FIG. 1H.

In another embodiment, while much of the disclosure depicts the nanostructure layer 104 as covering the entirety of the given transparent portion 102 of the plasma cell 101, the nanostructure layer 104 may be selectively formed at discrete portions of one or more surfaces of the transparent portion 102. For example, the nanostructure layer 104 may be formed at a position along the transparent portion 102 expect to receive pumping radiation 107 from the illumination source 111. By way of another example, the nanostructure layer 104 may be formed at a position along the transparent portion 102 expected to preferentially transmit broadband radiation 115 from the plasma 106 to downstream optics. The plasma bulb 114 of FIG. 1Q depicts a configuration where the nanostructure layer 104 is formed on a selected portion of the transparent portion 102. It is noted, however, that this configuration is not a limitation on the plasma bulb 114 of the present disclosure.

Referring to FIG. 1R, in one embodiment, the plasma cell 101 may include a transmission element 116 suitable for containing a volume of gas 108. The transmission element 116 is suitable for initiating and/or maintaining plasma 106. In this regard, the transparent portion 102 of the plasma cell 101 may consist of the transparent portion (or wall) of the transmission element 116, as shown in FIG. 1R. In one embodiment, the transmission element 116 is suited for transmitting light 107 from the pumping source 111 into the gas 108 and further suited for transmitting broadband radiation 115 from the plasma 106 to downstream optical elements.

As shown in FIG. 1R, the one or more nanostructure layers 104 may be formed on one or more surfaces of transmission element 116. For example, as shown in FIG. 1R, a nanostructure layer 104 of the present disclosure may be formed on the internal element-gas interface 103 in a manner similar to that described generally with respect to FIG. 1F. By way of another example, although not shown here, a nanostructure layer 104 of the present disclosure may be formed on the external element-air interface 105 in a manner similar to that described generally with respect to FIG. 1G. By way of another example, although not shown here, a first nanostructure layer 104 may be formed on the internal element-gas interface 103, with a second nanostructure layer 104 being formed on external element-air interface 105 in a manner similar to that described generally with respect to FIG. 1H In another embodiment, the transmission element 116 may include one or more openings (e.g., top and bottom openings). In another embodiment, one or more flanges 118, 120 are disposed at the one or more openings of the transmission element 116. In one embodiment, the one or more flanges 118, 120 are configured to enclose the internal volume of the transmission element 116 so as to contain a volume of gas 108 within the body of the transmission element 116. In one embodiment, the one or more openings may be located at one or more end portions of the transmission element 116. For example, as shown in FIG. 1R, a first opening may be located at a first end portion (e.g., top portion) of the transmission element 116, while a second opening may be located at a second end portion (e.g., bottom portion), opposite of the first end portion, of the transmission element 116. In another embodiment, the one or more flanges 118, 120 are arranged to terminate the transmission element 116 at the one or more end portions of the transmission element 116, as shown in FIG. 1R. For example, a first flange 118 may be positioned to terminate the transmission element 116 at the first opening, while the second flange 120 may be positioned to terminate the transmission element 116 at the second opening. In another embodiment, the first opening and the second opening are in fluidic communication with one another such that the internal volume of the transmission element 116 is continuous from the first opening to the second opening. In another embodiment, although not shown, the plasma cell 101 includes one or more seals. In one embodiment, the seals are configured to provide a seal between the body of the transmission element 116 and the one or more flanges 118, 120. The seals of the plasma cell 101 may include any seals known in the art. For example, the seals may include, but are not limited to, a brazing, an elastic seal, an O-ring, a C-ring, a metal seal and the like. In another embodiment, the top flange 118 and bottom flange 120 may be mechanically coupled via one or more connecting rods, thereby sealing the transmission element 116. The generation of plasma in a flanged plasma cell is also described in U.S. patent application Ser. No. 14/231,196, filed on Mar. 31, 2014, which is incorporated by reference herein in the entirety.

Referring again to FIG. 1A, in one embodiment, the plasma cell 101 may contain any selected gas (e.g., argon, xenon, mercury or the like) known in the art suitable for generating plasma upon absorption of suitable illumination. In one embodiment, focusing illumination 107 from the illumination source 111 into the volume of gas 108 causes energy to be absorbed through one or more selected absorption lines of the gas or plasma within the plasma cell 101 (e.g., within plasma bulb 114 or transmission element 116), thereby "pumping" the gas species in order to generate or sustain a plasma. In another embodiment, although not shown, the plasma cell 101 may include a set of electrodes for initiating the plasma 106 within the internal volume of the plasma cell 101, whereby pumping radiation 107 from the illumination source 111 maintains the plasma 106 after ignition by the electrodes.

It is contemplated herein that the system 100 may be utilized to initiate and/or sustain plasma 106 in a variety of gas environments. In one embodiment, the gas used to initiate and/or maintain plasma 106 may include an inert gas (e.g., noble gas or non-noble gas) or a non-inert gas (e.g., mercury). In another embodiment, the gas 108 used to initiate and/or maintain plasma 106 may include a mixture of gases (e.g., mixture of inert gases, mixture of inert gas with non-inert gas or a mixture of non-inert gases). For example, it is anticipated herein that the volume of gas 108 used to generate a plasma 106 may include argon. For instance, the gas 108 may include a substantially pure argon gas held at pressure in excess of 5 atm (e.g., 20-50 atm). In another instance, the gas 108 may include a substantially pure krypton gas held at pressure in excess of 5 atm (e.g., 20-50 atm). In another instance, the gas 108 may include a mixture of argon gas with an additional gas.

It is further noted that the system 100 may be implemented with a number of gases. For example, gases suitable for implementation in the system 100 of the present disclosure may include, but are not limited, to Xe, Ar, Ne, Kr, He, $N_2$, $H_2O$, $O_2$, $H_2$, $D_2$, $F_2$, $CH_4$, one or more metal halides, a halogen, Hg, Cd, Zn, Sn, Ga, Fe, Li, Na, Ar:Xe, ArHg, KrHg, XeHg, and the like. In a general sense, system 100 of the present disclosure should be interpreted to extend to any architecture suitable for light-sustained plasma generation and should further be interpreted to extend to any type of gas suitable for sustaining a plasma within a plasma cell.

The transparent portion 102 (e.g., bulb 114 or transmission element 116) of the plasma cell 101 of system 100 may be formed from any material known in the art that is at least partially transparent to radiation generated by plasma 106. In one embodiment, the transparent portion 102 of plasma cell 101 may be formed from any material known in the art that is at least partially transparent to VUV radiation generated by plasma 106. In another embodiment, the transparent portion 102 of plasma cell 101 may be formed from any material known in the art that is at least partially transparent to DUV radiation generated by plasma 106. In another embodiment, the transparent portion 102 of plasma cell 101 may be formed from any material known in the art that is at least partially transparent to EUV light generated by plasma 106. In another embodiment, the transparent portion 102 of plasma cell 101 may be formed from any material known in the art that is at least partially transparent to UV light generated by plasma 106. In another embodiment, the transparent portion 102 of plasma cell 101 may be formed from any material known in the art at least partially transparent to visible light generated by plasma 106.

In another embodiment, transparent portion 102 of plasma cell 101 may be formed from any material known in the art transparent to the pumping radiation 107 (e.g., IR radiation) from the illumination source 111. In another embodiment, the transparent portion 102 of plasma cell 101 may be formed from any material known in the art transparent to both radiation 107 from the illumination source 111 (e.g., IR source) and radiation 115 (e.g., VUV radiation, DUV radiation, EUV radiation, UV radiation and/or visible radiation) emitted by the plasma 106 contained within the volume of transparent portion 102 of plasma cell 101. In some embodiments, the transparent portion 102 of plasma cell 101 may be formed from a low-OH content fused silica glass material. In other embodiments, the transparent portion 102 of plasma cell 101 may be formed from high-OH content fused silica glass material. For example, the transparent portion 102 of plasma cell 101 may include, but is not limited to, SUPRASIL 1, SUPRASIL 2, SUPRASIL 300, SUPRASIL 310, HERALUX PLUS, HERALUX-VUV, and the like. In other embodiments, the transparent portion 102 of plasma cell 101 may include, but is not limited to, calcium fluoride ($CaF_2$), magnesium fluoride ($MgF_2$), lithium fluoride ($LiF_2$), crystalline quartz and sapphire. It is noted herein that materials such as, but not limited to, $CaF_2$, $MgF_2$, crystalline quartz and sapphire provide transparency to short-wavelength radiation (e.g., $\lambda<190$ nm). Various glasses suitable for implementation in the transparent portion 102 of plasma cell 101 of the present disclosure are discussed in detail in A. Schreiber et al., *Radiation Resistance of Quartz Glass for VUV Discharge Lamps*, J. Phys. D: Appl. Phys. 38 (2005), 3242-3250, which is incorporated herein by reference in the entirety.

It is noted herein that the one or more nanostructure layers 104 of the present disclosure may be formed at one or more surfaces of the plasma cell 101. In this regard, in the case of etching-based fabrication, the one or more nanostructure layers 104 may be formed by etching a surface of a transparent portion 102 formed of any of the materials noted above.

The transparent portion 102 (e.g., bulb 114 or transmission element 116) of the plasma cell 101 may take on any shape known in the art. In the case where the plasma cell 101 includes a transmission element 116, as shown in FIG. 1R, the transmission element 116 may have a cylindrical shape.

In another embodiment, although not shown, the transmission element 116 may have a spherical or ellipsoidal shape. In another embodiment, although not shown, the transmission element 116 may have a composite shape. For example, the shape of the transmission element 116 may consist of a combination of two or more shapes. For instance, the shape of the transmission element 116 may consist of a spherical or ellipsoidal center portion, arranged to contain the plasma 106, and one or more cylindrical portions extending above and/or below the spherical or ellipsoidal center portion, whereby the one or more cylindrical portions are coupled to the one or more flanges 118, 120. In the case where the transmission element 116 is cylindrically shaped, as shown in FIG. 1R, the one or more openings of the transmission element 116 may be located at the end portions of the cylindrically shaped transmission element 116. In this regard, the transmission element 116 takes the form of a hollow cylinder, whereby a channel extends from the first opening (top opening) to the second opening (bottom opening). In another embodiment, the first flange 118 and the second flange 120 together with the wall(s) of the transmission element 116 serve to contain the volume of gas 108 within the channel of the transmission element 116. It is recognized herein that this arrangement may be extended to a variety of transmission element 116 shapes, as described previously herein.

In settings where the plasma cell 101 includes a plasma bulb 114, as in FIG. 1Q, the plasma bulb 114 may also take on any shape known in the art. In one embodiment, the plasma bulb 114 may have a cylindrical shape. In another embodiment, the plasma bulb 114 may have a spherical or ellipsoidal shape. In another embodiment, the plasma bulb may have a composite shape. For example, the shape of the plasma bulb may consist of a combination of two or more shapes. For instance, the shape of the plasma bulb may consist of a spherical or ellipsoidal center portion, arranged to contain the plasma 106, and one or more cylindrical portions extending above and/or below the spherical or ellipsoidal center portion.

In another embodiment, the one or more nanostructure layers 104 of the present disclosure may be formed on one or more of the curved surfaces of the plasma cell 101. For example, in the case of a plasma bulb 114, the one or more nanostructure layers 104 may be formed on the internal surface 103 and/or the external surface 105, which are both curved in the case of the plasma bulb shapes described previously herein. By way of another example, in the case of a transmission element 116, the one or more nanostructure layers 104 may be formed on the internal surface 103 or the external surface 105, which are both curved in the case of the transmission element shapes described previously herein.

In another embodiment, the system 100 includes a collector/reflector element 105 configured to focus illumination emanating from the illumination source 111 into the volume of gas 108 contained within the plasma cell 101. The collector element 105 may take on any physical configuration known in the art suitable for focusing illumination emanating from the illumination source 111 into the volume of gas contained within the plasma cell 101. In one embodiment, as shown in FIG. 1A, the collector element 105 may include a concave region with a reflective internal surface suitable for receiving pumping radiation 107 from the illumination source 111 and focusing the pumping radiation 107 into the volume of gas contained within the plasma cell 101. For example, the collector element 105 may include an ellipsoid-shaped collector element 105 having a reflective internal surface, as shown in FIG. 1A.

In another embodiment, the collector element 105 is arranged to collect broadband illumination 115 (e.g., VUV radiation, DUV radiation, EUV radiation, UV radiation and/or visible radiation) emitted by plasma 106 and direct the broadband illumination to one or more additional optical elements (e.g., filter 123, homogenizer 125 and the like). For example, the collector element 105 may collect at least one of VUV broadband radiation, DUV radiation, EUV radiation, UV radiation or visible radiation emitted by plasma 106 and direct the broadband illumination 115 to one or more downstream optical elements. In this regard, the plasma cell 101 may deliver VUV radiation, DUV radiation, EUV radiation, UV radiation and/or visible radiation to downstream optical elements of any optical characterization system known in the art, such as, but not limited to, an inspection tool or a metrology tool. It is noted herein the plasma cell 101 of system 100 may emit useful radiation in a variety of spectral ranges including, but not limited to, VUV radiation, DUV radiation, EUV radiation, UV radiation, and/or visible radiation.

In one embodiment, system 100 may include various additional optical elements. In one embodiment, the set of additional optics may include collection optics configured to collect broadband light emanating from the plasma 106. For instance, the system 100 may include a cold mirror 121 arranged to direct illumination from the collector element 105 to downstream optics, such as, but not limited to, a homogenizer 125.

In another embodiment, the set of optics may include one or more lenses (e.g., lens 117) placed along either the illumination pathway or the collection pathway of system 100. The one or more lenses may be utilized to focus illumination from the illumination source 111 into the volume of gas 108 within the plasma cell 101. Alternatively, the one or more additional lenses may be utilized to focus broadband light emanating from the plasma 106 onto a selected target (not shown).

In another embodiment, the set of optics may include a turning mirror 119. In one embodiment, the turning mirror 119 may be arranged to receive pumping radiation 107 from the illumination source 111 and direct the illumination to the volume of gas 108 contained within the plasma cell 101 via collection element 105. In another embodiment, the collection element 105 is arranged to receive illumination from mirror 119 and focus the illumination to the focal point of the collection element 105 (e.g., ellipsoid-shaped collection element), where the plasma cell 101 is located.

In another embodiment, the set of optics may include one or more filters 123 placed along either the illumination pathway or the collection pathway in order to filter illumination prior to light entering the plasma cell 101 or to filter illumination following emission of the light from the plasma 106. It is noted herein that the set of optics of system 100 as described above and illustrated in FIG. 1A are provided merely for illustration and should not be interpreted as limiting. It is anticipated that a number of equivalent or additional optical configurations may be utilized within the scope of the present invention.

In another embodiment, the illumination source 111 of system 100 may include one or more lasers. In a general sense, the illumination source 111 may include any laser system known in the art. For instance, the illumination source 111 may include any laser system known in the art capable of emitting radiation in the infrared, visible or ultraviolet portions of the electromagnetic spectrum. In one embodiment, the illumination source 111 may include a laser system configured to emit continuous wave (CW) laser radiation. For example, the illumination source 111 may include one or more CW infrared laser sources. For instance, in settings where the gas within the plasma cell 101 is or includes argon, the illumination source 111 may include a CW laser (e.g., fiber laser or disc Yb laser) configured to emit radiation at 1069 nm. It is noted that this wavelength fits to a 1068 nm absorption line in argon and, as such, is particularly useful for pumping argon gas. It is noted herein that the above description of a CW laser is not limiting and any laser known in the art may be implemented in the context of the present invention.

In another embodiment, the illumination source 111 may include one or more diode lasers. For example, the illumination source 111 may include one or more diode lasers emitting radiation at a wavelength corresponding with any one or more absorption lines of the species of the gas contained within the plasma cell 101. In a general sense, a diode laser of the illumination source 111 may be selected for implementation such that the wavelength of the diode laser is tuned to any absorption line of any plasma (e.g., ionic transition line) or any absorption line of the plasma-producing gas (e.g., highly excited neutral transition line) known in the art. As such, the choice of a given diode laser (or set of diode lasers) will depend on the type of gas contained within the plasma cell 101 of system 100.

In another embodiment, the illumination source 111 may include an ion laser. For example, the illumination source 111 may include any noble gas ion laser known in the art. For instance, in the case of an argon-based plasma, the illumination source 111 used to pump argon ions may include an Ar+ laser.

In another embodiment, the illumination source 111 may include one or more frequency converted laser systems. For example, the illumination source 111 may include a Nd:YAG or Nd:YLF laser having a power level exceeding 100 watts. In another embodiment, the illumination source 111 may include a broadband laser. In another embodiment, the illumination source may include a laser system configured to emit modulated laser radiation or pulsed laser radiation.

In another embodiment, the illumination source 111 may include one or more lasers configured to provide laser light at substantially a constant power to the plasma 106. In another embodiment, the illumination source 111 may include one or more modulated lasers configured to provide modulated laser light to the plasma 106. In another embodiment, the illumination source 111 may include one or more pulsed lasers configured to provide pulsed laser light to the plasma.

In another embodiment, the illumination source 111 may include one or more non-laser sources. In a general sense, the illumination source 111 may include any non-laser light source known in the art. For instance, the illumination source 111 may include any non-laser system known in the art capable of emitting radiation discretely or continuously in the infrared, visible or ultraviolet portions of the electromagnetic spectrum.

In another embodiment, the illumination source 111 may include two or more light sources. In one embodiment, the illumination source 111 may include or more lasers. For example, the illumination source 111 (or illumination sources) may include multiple diode lasers. By way of another example, the illumination source 111 may include multiple CW lasers. In a further embodiment, each of the two or more lasers may emit laser radiation tuned to a different absorption line of the gas or plasma within the plasma cell 101 of system 100.

Figure 2:
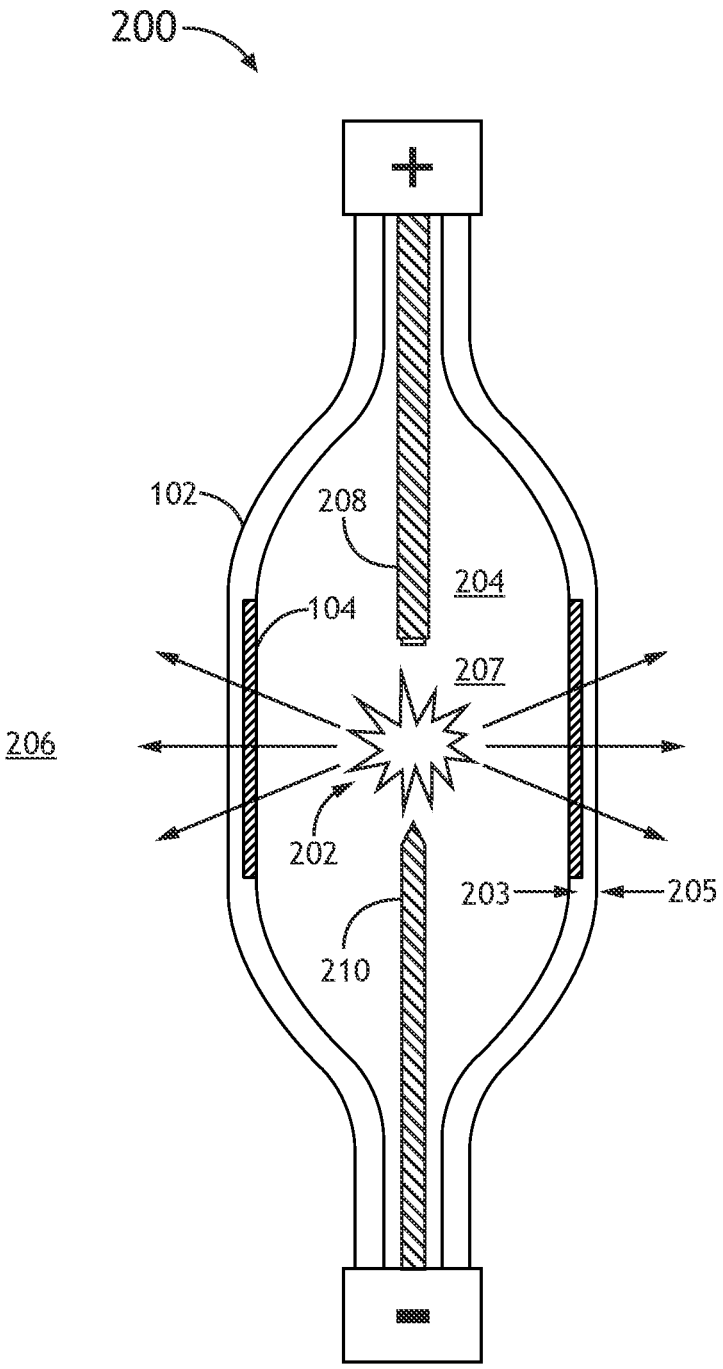
FIG. 2 is a cross-sectional view of an arc lamp equipped with a nanostructure layer, in accordance with one embodiment of the present disclosure.

FIG. 2 illustrates an arc lamp 200 equipped with the nanostructure layer 104, in accordance with one or more embodiments of the present disclosure. While much of the present disclosure has described the implementation of the nanostructure layer 104 in the context of a laser-pumped plasma source (e.g., plasma cell 101), the present disclosure is not limited to such a configuration. The nanostructure layer 104 of the present disclosure may be implemented in the context of any high temperature optical setting where low reflectivity is desired on one or more optical surfaces.

It is noted herein that the various embodiments and examples of the plasma cell 101 described previously herein with respect to FIGS. 1A-FIG. 1R should be interpreted to extend to the arc lamp 200 of FIG. 2. For instance, the materials used to fabricate the arc lamp 200 and the structural configuration of the nanostructure layer 104 may take similar forms as those described previously herein in the context of plasma cell 101.

In one embodiment, the arc lamp 200 includes one or more nanostructure layers 104 disposed on one or more optical surfaces of the arc lamp 200. In one embodiment, the one or more nanostructure layers 104 are disposed on a transparent portion 102 of the arc lamp 200.

In one embodiment, the one more nanostructure layers 104 are disposed on an internal surface 203 of the transparent portion 102 of the arc lamp 200. For example, the nanostructure layer 104 may be, but is not required to be, formed at an internal interface defined by the lamp gas 204 and the transparent portion 102 of the lamp 200.

In another embodiment, although not shown, the one more nanostructure layers 104 are disposed on an external surface 205 of the transparent portion 102 of the arc lamp 200. For example, the nanostructure layer 104 may be, but is not required to be, formed at an external interface defined by the transparent portion 102 of the lamp 200 and an external atmosphere 206 (e.g., air, purge gas and the like).

In another, although not shown, a first nanostructure layer 104 is disposed on an internal surface 203 of the transparent portion of the arc lamp 200, while a second nanostructure layer 104 is disposed on an external surface 205 of the transparent portion 102 of the arc lamp 200.

As described previously herein, the one or more nanostructure layers 104 formed at the internal surface 203 and/or external surface 205 of the arc lamp may serve to reduce reflectivity at the internal and/or external surface 205. As such, the illumination output 207 from the discharge 202 of the arc lamp experiences reduced Fresnel loss, providing an improved illumination output.

It is noted herein that the arc lamp 200 of the present disclosure may take on the form of any arc lamp known in the art and is not limited to the configuration depicted in FIG. 2. In one embodiment, the arc lamp 200 may include a set of electrodes 208, 210. For example, the arc lamp 200 may include, but is not limited to, the anode 208 and cathode 210 as depicted in FIG. 2.

It is noted herein that the gas 204 used in the arc lamp may include any gas used in the art of arc lamps. For example, the gas 204 may include, but is not limited to, one or more of Xe, Hg, Xe—Hg, Ar and the like.

It is further noted that the nanostructure layer 104 of the present disclosure may be implemented in the context of any discharge lamp known in the art and is not limited to an arc-type discharge lamp.

Figure 3:
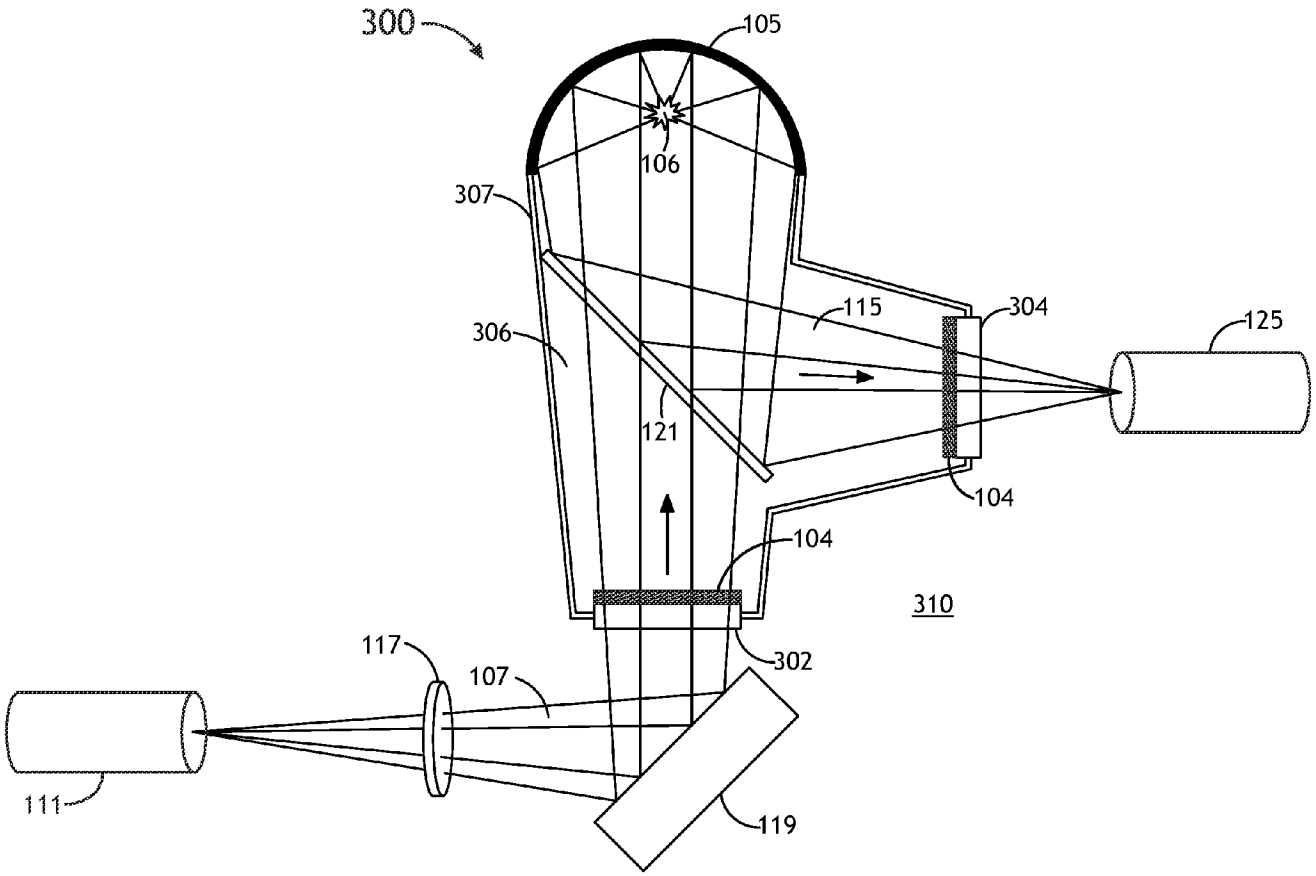
FIG. 3 is a high-level schematic view of a bulb-less system for generating plasma-based broadband light including one or more optical surfaces with one or more nanostructure layers, in accordance with one embodiment of the present disclosure.

FIG. 3 illustrates a bulb-less illumination source 300 for generating plasma-based broadband radiation, in accordance with one or more embodiments of the present disclosure. While much of the present disclosure has focused on the implementation of the nanostructure layer 104 in the context of plasma cell 101 or arc lamp 200, where a gas environment is maintained in a small volume, this is not a limitation on the implementation of the nanostructure layer 104 of the present disclosure. It is recognized herein that the nanostructure layer 104 may be implemented on any transparent optical surface where transmission of light is desired. The bulb-less illumination source 300 illustrates one such environment. The bulb-less light source 300 is configured to establish and maintain plasma 106 within a gas 306 contained in a gas containment structure 307 (e.g., chamber 307). For example, as shown in FIG. 3, a plasma 106 may be established and maintained in the gas 306 contained within the volume defined by the gas containment structure 307 (e.g., chamber) and/or the collector element 105.

In another embodiment, the gas containment structure 307 is operably coupled to the collector element 105. For example, as shown in FIG. 3, the collector element 105 is disposed on an upper portion of containment structure 307. By way of another example, although not shown, the collector element 105 may be disposed inside of the gas containment structure 307. It is noted herein that the present disclosure is not limited to the above description or the depiction of source 300 in FIG. 3 as it is contemplated herein that source 300 may encompass a number of bulb-less configurations suitable for initiating and/or maintaining a plasma in accordance with the present invention.

The generation of plasma in a bulb-less light source is generally described in U.S. patent application Ser. No. 14/224,945, filed on Mar. 25, 2014, which is incorporated above in the entirety. A bulb-less laser sustained plasma light source is also generally described in U.S. patent application Ser. No. 12/787,827, filed on May 26, 2010, which is incorporated herein by reference in the entirety.

It is noted herein that the various embodiments and examples of the plasma cell 101 and arc lamp 200 described previously herein with respect to FIGS. 1A-FIG. 2 should be interpreted to extend to the bulb-less source 300 of FIG. 3. For instance, the materials used to fabricate the transparent optical elements of the source 300 and the structural configuration of the nanostructure layer 104 may take similar forms as those described previously herein in the context of plasma cell 101 and arc lamp 200.

In one embodiment, the source 300 includes one or more transparent portions 302, 304 equipped with one or more nanostructure layers 104. For example, the one or more transparent portions 302, 304 may include, but are not limited to, windows 302, 304 equipped with one or more nanostructure layers 104. In one embodiment, the source 300 includes an input window 302 for receiving pumping radiation 107 from the pumping source 111. In one embodiment, the input window 302 includes one or more nanostructure layers 104 disposed at an internal or external surface of the input window 302. For example, as shown in FIG. 3, the nanostructure layer 104 may be, but is not required to be, disposed on an internal surface of the window 302 defined by the interface between the gas 306 and the material of the window 302. By way of another example, although not shown, the nanostructure layer 104 may be, but is not required to be, disposed on an external surface of the window 302 defined by the interface between the material of the window 302 and an external gas 310 (e.g., air, purging gas and the like). By way of another example, although not shown, a first nanostructure layer 104 may be, but is not required to be, formed on an internal surface of the window 302, while a second nanostructure layer 104 may be, but is not required to be, formed on an external surface of the window 302.

In another embodiment, the source 300 includes an output window 304 for transmitting broadband illumination 115 from the plasma 106 to downstream optical components (e.g., homogenizer 125). In one embodiment, the output window 304 includes one or more nanostructure layers 104 disposed at an internal or external surface of the output window 304. For example, as shown in FIG. 3, the nanostructure layer 104 may be, but is not required to be, disposed on an internal surface of the window 304 defined by the interface between the gas 306 and the material of the window 304. By way of another example, although not shown, the nanostructure layer 104 may be, but is not required to be, disposed on an external surface of the window 304 defined by the interface between the material of the window 302 and an external gas (e.g., air, purging gas and the like). By way of another example, although not shown, a first nanostructure layer 104 may be, but is not required to be, formed on an internal surface of the window 302, while a second nanostructure layer 104 may be, but is not required to be, formed on an external surface of the window 302.

In this regard, the one or more nanostructure layers 104 formed at the internal and/or external surfaces of window 302 and/or window 304 of the source 300 may serve to reduce reflectivity at the internal and/or external surfaces of window 302 and/or window 304. As such, the pumping radiation 107 and/or the broadband illumination output 115 from the plasma 106 may experience reduced Fresnel loss, providing an improved illumination output 115.

It is noted herein that the present disclosure is not limited to the particular configuration of source 300. It is recognized herein that the one or more nanostructure layers 104 may be formed on any transparent optical surface used to couple pumping radiation to the plasma and/or used to couple broadband radiation to downstream optics.

Figure 4:
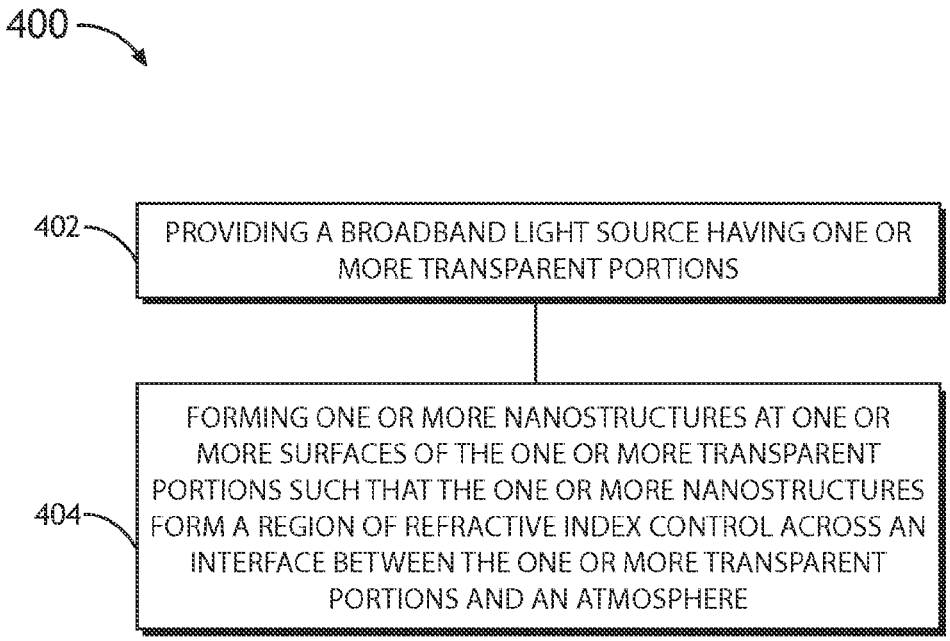
FIG. 4 is a flow diagram illustrating a method for fabricating a broadband light source with one or more antireflective surfaces, in accordance with one embodiment of the present invention.

FIG. 4 illustrates a process flow diagram depicting a method 400 for fabricating a light source with one or more antireflective optical surfaces. In step 402, a lamp having one or more transparent portions is provided. For example, the provided lamp may include, but is not limited to, a plasma cell 101 having one or more transparent portions 102. For instance, the plasma cell 101 may include, but is not limited to, a plasma bulb 114 having one or more transparent portions 102 or a transmission element 116 having one or more transparent portions 102. By way of another example, the provided lamp may include, but is not limited to, an arc lamp 200 including one or more transparent portions 102.

In step 404, one or more nanostructures are formed at one or more surfaces of the one or more transparent portions of the lamp. In this regard, the one or more nanostructures form a region of refractive index control (e.g., extended interface 109) between the one or more transparent portions of the plasma cell and at least one of a volume internal to the plasma cell or a volume external to the plasma cell. In one embodiment, the one or more nanostructures are etched (e.g., plasma etched) into the one or more surfaces of the one or more transparent portions of the lamp.

While the present disclosure has focused on the implementation of the one or more nanostructure layers 104 in the context of broadband light generation in sample (e.g., wafer) inspection tools, it is contemplated herein that the embodiments of the present disclosure may be extended to any optical setting where the use of dielectric-based AR coatings are insufficient. For example, in addition to broadband inspection, it is recognized herein that the one or more nanostructure layers 104 of the present disclosure may be formed on one or more transparent optical interfaces of a scatterometer, reflectometer, ellipsometer or optical metrology tool.

The herein described subject matter sometimes illustrates different components contained within, or connected with, other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "connected", or "coupled", to each other to achieve the desired functionality, and any two components capable of being so associated can also be viewed as being "couplable", to each other to achieve the desired functionality. Specific examples of couplable include but are not limited to physically interactable and/or physically interacting components.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes. Furthermore, it is to be understood that the invention is defined by the appended claims.

What is claimed:

1. A laser-sustained plasma light source comprising:

a plasma cell configured to contain a volume of gas, the plasma cell configured to receive illumination from a pump laser in order to generate a plasma within the volume of gas, wherein the plasma emits broadband radiation, the plasma cell including:

one or more transparent portions being at least partially transparent to at least a portion of illumination from the pump laser and at least a portion of the broadband radiation emitted by the plasma; and one or more nanostructured layers disposed on one or more curved surfaces of the one or more transparent portions of the plasma cell, wherein the one or more nanostructure layers form a region of refractive index control across an interface between the one or more transparent portions of the plasma cell and an atmosphere.

2. The light source of claim 1, wherein the one or more nanostructured layers form a region of refractive index control across an interface between the one or more transparent portions of the plasma cell and an atmosphere contained within the plasma cell.

3. The light source of claim 1, wherein the one or more nanostructured layers form a region of refractive index control across an interface between the one or more transparent portions of the plasma cell and an atmosphere external to the plasma cell.

4. The light source of claim 1, wherein the one or more nanostructure layers form a region of continuous change in refractive index across an interface between the one or more transparent portions of the plasma cell and an atmosphere.

5. The light source of claim 1, wherein the one or more nanostructure layers form a region of change in refractive index according to a selected profile across an interface between the one or more transparent portions of the plasma cell and an atmosphere.

6. The light source of claim 1, wherein the one or more nanostructure layers are configured to reduce Fresnel loss below a selected level across an interface between the one or more transparent portions and an atmosphere.

7. The light source of claim 1, wherein the plasma cell includes a plasma bulb.

8. The light source of claim 1, wherein the plasma cell includes:

a transmission element; and one or more flanges disposed one or more openings of the transmission element, the one or more flanges configured to enclose an internal volume of the transmission element in order to contain a volume of the gas within the transmission element.

9. The light source of claim 1, wherein the one or more nanostructure layers and the one or more transparent portions are formed from the same material.

10. The light source of claim 1, wherein the one or more nanostructure layers are formed from a first material and the one or more transparent portions are formed from a second material different from the first material.

11. The light source of claim 1, wherein each of the one or more nanostructure layers comprise:

a set of structures formed across a curved surface of at least a portion of the one or more transparent portions of the plasma cell.

12. The light source of claim 11, wherein the set of structures formed across a curved surface of at least a portion of the one or more transparent portions of the plasma cell comprise:

a set of periodic structures formed across a curved surface of at least a portion of the one or more transparent portions of the plasma cell.

13. The light source of claim 12, wherein the periodic structures are formed across the curved surface of the one or more transparent portions of the plasma cell at a selected pitch.

14. The light source of claim 13, wherein the selected pitch includes a spacing smaller than the one or more wavelengths of illumination from the pump laser.

15. The light source of claim 13, wherein the selected pitch includes a spacing smaller than one or more wavelengths of at least a portion of broadband illumination emitted by the plasma.

16. The light source of claim 12, wherein the periodic structures have a characteristic height.

17. The light source of claim 12, wherein the periodic structures have a characteristic width.

18. The light source of claim 11, wherein the set of structures formed across a curved surface of at least a portion of the one or more transparent portions of the plasma cell comprise:

a set of non-periodic structures formed across a curved surface of at least a portion of the one or more transparent portions of the plasma cell.

19. The light source of claim 18, wherein a first spacing between a first structure and second structure is different from a second spacing between the second structure and at least a third structure of the set of non-periodic structures.

20. The light source of claim 18, wherein a characteristic feature of a first structure of the set of non-periodic structures is different from a characteristic feature of at least a second structure of the set of non-periodic structures.

21. The light source of claim 20, wherein a shape of a first structure of the set of non-periodic structures is different from a shape of at least a second structure of the set of non-periodic structures.

22. The light source of claim 20, wherein a height of a first structure of the set of non-periodic structures is different from a height of at least a second structure of the set of non-periodic structures.

23. The light source of claim 20, wherein a width of a first structure of the set of non-periodic structures is different from a width of at least a second structure of the set of non-periodic structures.

24. The light source of claim 11, wherein at least some of the structures include at least one of a nanoroad, a nanocone, a truncated nanocore or a nanoparoboloid.

25. The light source of claim 1, wherein the transparent portion of the plasma cell is formed from at least one of calcium fluoride, magnesium fluoride, lithium fluoride, crystalline quartz, sapphire or fused silica.

26. The light source of claim 1, wherein the gas comprises:

at least one of an inert gas, a non-inert gas and a mixture of two or more gases.

27. An apparatus for generating broadband laser-sustained plasma light comprising:

one or more pump lasers configured to generate illumination;

a plasma cell configured to contain a volume of gas, the plasma cell configured to receive illumination from the one or more pump lasers in order to generate a plasma within the volume of gas, wherein the plasma emits broadband radiation, the plasma cell including:

one or more transparent portions being at least partially transparent to at least a portion of illumination from the pump laser and at least a portion of the broadband radiation emitted by the plasma; and one or more nanostructured layers disposed on one or more curved surfaces of the one or more transparent portions of the plasma cell, wherein the one or more nanostructure layers form a region of refractive index control across an interface between the one or more transparent portions of the plasma cell and an atmosphere; and a collector element arranged to focus the illumination from the one or more pump lasers into the volume of gas in order to generate a plasma within the volume of gas contained within the plasma cell.

28. The apparatus of claim 27, wherein the collector element is arranged to collect at least a portion of the broadband radiation emitted by the generated plasma and direct the broadband radiation to one or more additional optical elements.

29. The apparatus of claim 27, wherein the collector element comprises:

an ellipsoid-shaped collector element.

30. The apparatus of claim 27, wherein the one or more pumping lasers comprise:

one or more infrared lasers.

31. The apparatus of claim 27, wherein the one or more pumping lasers comprise:

at least one of a diode laser, a continuous wave laser, or a broadband laser.

32. The apparatus of claim 27, wherein the one or more pumping lasers comprise:

one or more lasers configured to provide laser light at substantially a constant power to the plasma.

33. The apparatus of claim 27, wherein the one or more pumping lasers comprise:

one or more modulated lasers configured to provide modulated laser light to the plasma.

34. A light source comprising:

an arc lamp configured to contain a volume of gas, wherein the arc lamp comprises:

a set of electrodes configured to generate a discharge within the volume of gas;

one or more transparent portions being at least partially transparent to at least a portion of the broadband radiation emitted associated with the discharge; and one or more nanostructured layers disposed on one or more curved surfaces of the one or more transparent portions of the arc lamp, wherein the one or more nanostructure layers form a region of refractive index control across an interface between the one or more transparent portions of the arc lamp and an atmosphere.

35. An apparatus for generating broadband laser-sustained plasma light comprising:

one or more pumping lasers configured to generate illumination; and a gas containment structure;

a collector element including a concave region mechanically coupled to the gas containment structure in order to contain a volume of gas, wherein the collector element is arranged to focus the illumination from the one or more pumping lasers into the volume of gas to generate a plasma within the volume of gas contained by the concave region of the collector element and the gas containment structure;

a first transparent portion configured to transmit illumination from the one or more pumping lasers into the gas containment structure; and an additional transparent portion different from the first transparent portion configured to transmit broadband radiation from the plasma to a region external to the gas containment structure, wherein one or more nanostructure layers are formed on one or more surfaces of at least one of the first transparent portion or the additional transparent portion different from the first transparent portion, wherein the one or more nanostructure layers form a region of refractive index control across an interface defined by at least one of the first transparent portion or the additional transparent portion different from the first transparent portion and at least one of a gas internal to the gas containment structure or a gas external to the gas containment structure.

36. The apparatus of claim 35, wherein the gas containment structure comprises:

a chamber.

37. The apparatus of claim 35, wherein the collector element is arranged to collect broadband illumination emitted by the generated plasma and direct the broadband illumination to one or more additional optical elements via the additional transparent portion different from the first transparent portion.

38. The apparatus of claim 35, wherein the collector element comprises:

an ellipsoid-shaped collector element.

39. The apparatus of claim 35, wherein the one or more pumping lasers comprise:

at least one of a diode laser, a continuous wave laser, or a broadband laser.

40. The apparatus of claim 35, wherein the gas comprises:

at least one of an inert gas, a non-inert gas and a mixture of two or more gases.

41. A method for forming a broadband light source with one or more antireflective surfaces comprising:

providing a lamp having one or more transparent portions; and forming one or more nanostructures at one or more curved surfaces of the one or more transparent portions of the lamp such that the one or more nanostructures form a region of refractive index control between the one or more transparent portions of the plasma cell and at least one of a volume internal to the plasma cell or a volume external to the plasma cell.

42. The method of claim 41, wherein the providing a lamp having one or more transparent portions comprises:

providing a plasma cell having one or more transparent portions.

43. The method of claim 41, wherein the providing a plasma cell having one or more transparent portions comprises:

providing a plasma cell including a plasma bulb having one or more transparent portions.

44. The method of claim 41, wherein the providing a plasma cell having one or more transparent portions comprises:

providing a plasma cell including a transmission element having one or more transparent portions.

45. The method of claim 41, wherein the providing a lamp having one or more transparent portions comprises:

providing an arc lamp including one or more transparent portions.

46. The method of claim 41, wherein forming one or more nanostructures at one or more curved surfaces of the one or more transparent portions of the lamp comprises:

forming one or more nanostructures into one or more curved surfaces of the one or more transparent portions of the lamp with an etching process.

47. The method of claim 41, wherein forming one or more nanostructures at one or more curved surfaces of the one or more transparent portions of the lamp comprises:

forming one or more nanostructures at the one or more curved surfaces of the one or more transparent portions of the lamp with a molding process.

48. The method of claim 41, wherein the region of refractive index control between the one or more transparent portions of the lamp and at least one of a volume internal to the lamp or a volume external to the lamp comprises:

a region of continuous change in refractive index between the one or more transparent portions of the lamp and at least one of a volume internal to the lamp or a volume external to the lamp.

49. The method of claim 41, wherein the region of refractive index control between the one or more transparent portions of the lamp and at least one of a volume internal to the lamp or a volume external to the lamp comprises:

a region of change in refractive index according to a selected profile between the one or more transparent portions of the plasma cell and at least one of a volume internal to the lamp or a volume external to the lamp.

* * * * *